US008051923B2

(12) United States Patent
Chen et al.

(10) Patent No.: US 8,051,923 B2
(45) Date of Patent: Nov. 8, 2011

(54) ROTARY DRILL BITS WITH GAGE PADS HAVING IMPROVED STEERABILITY AND REDUCED WEAR

(75) Inventors: Shilin Chen, The Woodlands, TX (US); Riun Ashlie, Calgary (CA)

(73) Assignee: Halliburton Energy Services, Inc., Houston, TX (US)

( * ) Notice: Subject to any disclaimer, the term of this patent is extended or adjusted under 35 U.S.C. 154(b) by 66 days.

(21) Appl. No.: 12/600,832

(22) PCT Filed: May 27, 2008

(86) PCT No.: PCT/US2008/064862

§ 371 (c)(1), (2), (4) Date: Nov. 18, 2009

(87) PCT Pub. No.: WO2008/150765

PCT Pub. Date: Dec. 11, 2008

(65) Prior Publication Data

US 2010/0163312 A1 Jul. 1, 2010

Related U.S. Application Data

(60) Provisional application No. 60/940,906, filed on May 30, 2007.

(51) Int. Cl.
*E21B 10/42* (2006.01)

(52) U.S. Cl. ..... 175/57; 175/408

(58) Field of Classification Search ..... 175/57, 175/331, 408

See application file for complete search history.

(56) References Cited

U.S. PATENT DOCUMENTS

| | | | | |
|---|---|---|---|---|
| 3,269,470 | A | 8/1966 | Kelly | 175/410 |
| 4,512,426 | A | 4/1985 | Bidegaray | 175/329 |
| 4,696,354 | A | 9/1987 | King et al. | 175/329 |
| 4,889,017 | A | 12/1989 | Fuller et al. | 76/108 A |
| 5,099,929 | A | 3/1992 | Keith et al. | 175/61 |
| 5,131,480 | A | 7/1992 | Lockstedt et al. | 175/374 |
| 5,595,252 | A | 1/1997 | O'Hanlon | 175/57 |
| 5,605,198 | A | 2/1997 | Tibbitts et al. | 175/432 |
| 5,607,024 | A | 3/1997 | Keith et al. | 175/431 |
| 5,787,022 | A | 7/1998 | Tibbitts et al. | 364/578 |
| 5,950,747 | A | 9/1999 | Tibbitts et al. | 175/432 |
| 5,960,896 | A | 10/1999 | Barr et al. | 175/431 |
| 5,967,247 | A | 10/1999 | Pessier | 175/408 |
| 6,003,623 | A | 12/1999 | Miess | 175/430 |

(Continued)

OTHER PUBLICATIONS

International Search Report and Written Opinion; PCT/US2008/064862; pp. 10, Sep. 2, 2008.

(Continued)

*Primary Examiner* — William P Neuder

(74) *Attorney, Agent, or Firm* — Baker Botts L.L.P.

(57) ABSTRACT

A rotary drill bit having blades with gage pads disposed on exterior portions thereof to improve steerability of the rotary drill bit during formation of a directional wellbore without sacrifice of lateral stability. One or more of the gage pads may include radially tapered exterior portions and/or cut out portions to assist with reducing wear of the associated gage pad. For some applications, a rotary drill bit may be formed having blades with gage pads having a relatively uniform exterior surface. Hard facing material and/or buttons may be disposed on exterior portions of the gage pad to form a radially tapered portion to improve steerability, reduce wear of the gage pad and/or improve ability of the rotary drill to form a wellbore having a generally uniform inside diameter, particularly during directional drilling of the wellbore.

24 Claims, 10 Drawing Sheets

U.S. PATENT DOCUMENTS

| | | | | |
|---|---|---|---|---|
| 6,021,859 | A | 2/2000 | Tibbitts et al. | 175/431 |
| 6,123,160 | A | 9/2000 | Tibbitts | 175/385 |
| 6,138,780 | A | 10/2000 | Beuershausen | 175/408 |
| 6,302,223 | B1 | 10/2001 | Sinor | 175/393 |
| 6,302,224 | B1 | 10/2001 | Sherwood, Jr. | 175/397 |
| 6,308,790 | B1 | 10/2001 | Mensa-Wilmot et al. | 175/73 |
| 6,499,547 | B2 | 12/2002 | Scott et al. | 175/374 |
| 6,640,913 | B2 | 11/2003 | Lockstedt et al. | 175/331 |
| 6,845,828 | B2 | 1/2005 | Boyce | 175/420.2 |
| 7,059,430 | B2 | 6/2006 | Singh et al. | 175/339 |
| 7,083,010 | B2 | 8/2006 | Eppink et al. | 175/325.2 |
| 2007/0022185 | A1 | 1/2007 | Hamilton et al. | 709/220 |
| 2007/0029113 | A1 | 2/2007 | Chen | 175/45 |
| 2007/0205024 | A1* | 9/2007 | Mensa-Wilmot | 175/408 |

OTHER PUBLICATIONS

Written Opinion; PCT/US2008/064862; 5 pages, Apr. 20, 2011.

* cited by examiner

ROTARY DRILL BITS WITH GAGE PADS HAVING IMPROVED STEERABILITY AND REDUCED WEAR

CROSS REFERENCE TO RELATED APPLICATIONS

This application is a U.S. National Stage Application of International Application No. PCT/US2008/064862 filed May 27, 2008, which designates the United States of America, and claims the benefit of U.S. Provisional Patent Application No. 60/940,906, filed May 30, 2007. The contents of which are hereby incorporated herein in their entirety by this reference.

TECHNICAL FIELD

The present disclosure is related to rotary drill bits and particularly to fixed cutter drill bits having blades with cutting elements and gage pads disposed therein and also roller cone drill bits.

BACKGROUND OF THE DISCLOSURE

Various types of rotary drill bits, reamers, stabilizers and other downhole tools may be used to form a borehole in the earth. Examples of such rotary drill bits include, but are not limited to, fixed cutter drill bits, drag bits, PDC drill bits, matrix drill bits, roller cone drill bits, rotary cone drill bits and rock bits used in drilling oil and gas wells. Cutting action associated with such drill bits generally requires weight on bit (WOB) and rotation of associated cutting elements into adjacent portions of a downhole formation. Drilling fluid may also be provided to perform several functions including washing away formation materials and other downhole debris from the bottom of a wellbore, cleaning associated cutting elements and cutting structures and carrying formation cuttings and other downhole debris upward to an associated well surface.

Some prior art rotary drill bits have been formed with blades extending from a bit body with a respective gage pad disposed proximate an uphole edge of each blade. Gage pads have been disposed at a positive angle or positive taper relative to a rotational axis of an associated rotary drill bit. Gage pads have also been disposed at a negative angle or negative taper relative a rotational axis of an associated rotary drill bit. Such gage pads may sometimes be referred to as having either a positive "axial" taper or a negative "axial" taper. See for example U.S. Pat. No. 5,967,247. The rotational axis of a rotary drill bit will generally be disposed on and aligned with a longitudinal axis extending through straight portions of a wellbore formed by the associated rotary drill bit. Therefore, the axial taper of associated gage pads may also be described as a "longitudinal" taper.

Gage pads formed with a positive axial taper may increase steerability of an associated rotary drill bit. Drag torque may also be reduced as a result of forming a gage pad with a positive axial taper. However, lateral stability of an associated rotary drill bit relative to a longitudinal axis extending through a wellbore being formed by the rotary drill bit may be reduced. Also, the ability of the associated rotary drill bit to maintain a generally uniform inside diameter of the wellbore may be reduced.

For other applications gage pads have been offset a relatively uniform radial distance from adjacent portions of a wellbore formed by a associated rotary drill bit. Exterior portions of such gage pads may be generally disposed approximately parallel with an associated bit rotational axis and adjacent portions of a straight wellbore. The amount of offset between exterior portions of such gage pads and adjacent portions of a straight wellbore will typically be relatively uniform. For some applications gage pads have been formed with a relatively uniform radial offset or uniform reduced outside diameter between approximately 1/64 of an inch to 4/64 of an inch as compared to a nominal diameter of the associated rotary drill bit.

Providing gage pads with an offset from an associated nominal bit diameter or undersizing gage pads may increase steerability of an associated rotary drill bit. However, lateral stability relative to a longitudinal axis of an associated wellbore and ability of the rotary drill bit to ream or form the wellbore with a generally uniform inside diameter may be reduced.

SUMMARY OF THE DISCLOSURE

In accordance with teachings of the present disclosure, a rotary drill bit may be formed with a plurality of blades having a respective gage portion or gage pad disposed on each blade. At least one gage pad may have an exterior tapered portion and/or an exterior recessed portion incorporating teachings of the present disclosure. Gage pads designed in accordance with teachings of the present disclosure may experience reduced wear and erosion while forming a wellbore, particularly non-vertical and non-straight wellbores.

Gage pads incorporating teachings of the present disclosure may improve steerability of an associated rotary drill bit while maintaining desired lateral stability of the rotary drill bit. Gage pads incorporating teachings of the present disclosure may also improve the ability of an associated rotary drill bit to form a wellbore with a more uniform inside diameter. A rotary drill bit formed in accordance with teachings of the present disclosure may often form a wellbore having a relatively uniform inside diameter which may generally correspond with an associated nominal diameter of the rotary drill bit. One aspect of the present disclosure may include designing rotary drill bits in accordance with teachings of the present disclosure having respective gage pads disposed on blades of a fixed cutter rotary drill bit or support arms of a roller cone drill bit to optimize downhole drilling performance. For some applications such gage pads may have exterior configurations which cooperate with other features of the associated rotary drill bit to improve steerability, particularly during formation of non-vertical or non-straight wellbores without sacrificing lateral stability of the rotary drill bit. For other applications such gage pads may improve ability of an associated rotary drill bit to ream a wellbore or form a wellbore with a more uniform inside diameter, particularly during formation of a non-vertical or non-straight wellbore.

BRIEF DESCRIPTION OF THE DRAWINGS

A more complete and thorough understanding of the present embodiments and advantages thereof may be acquired by referring to the following description taken in conjunction with the accompanying drawings, in which like reference numbers indicate like features, and wherein.

DETAILED DESCRIPTION OF THE DISCLOSURE

Figure 1A:
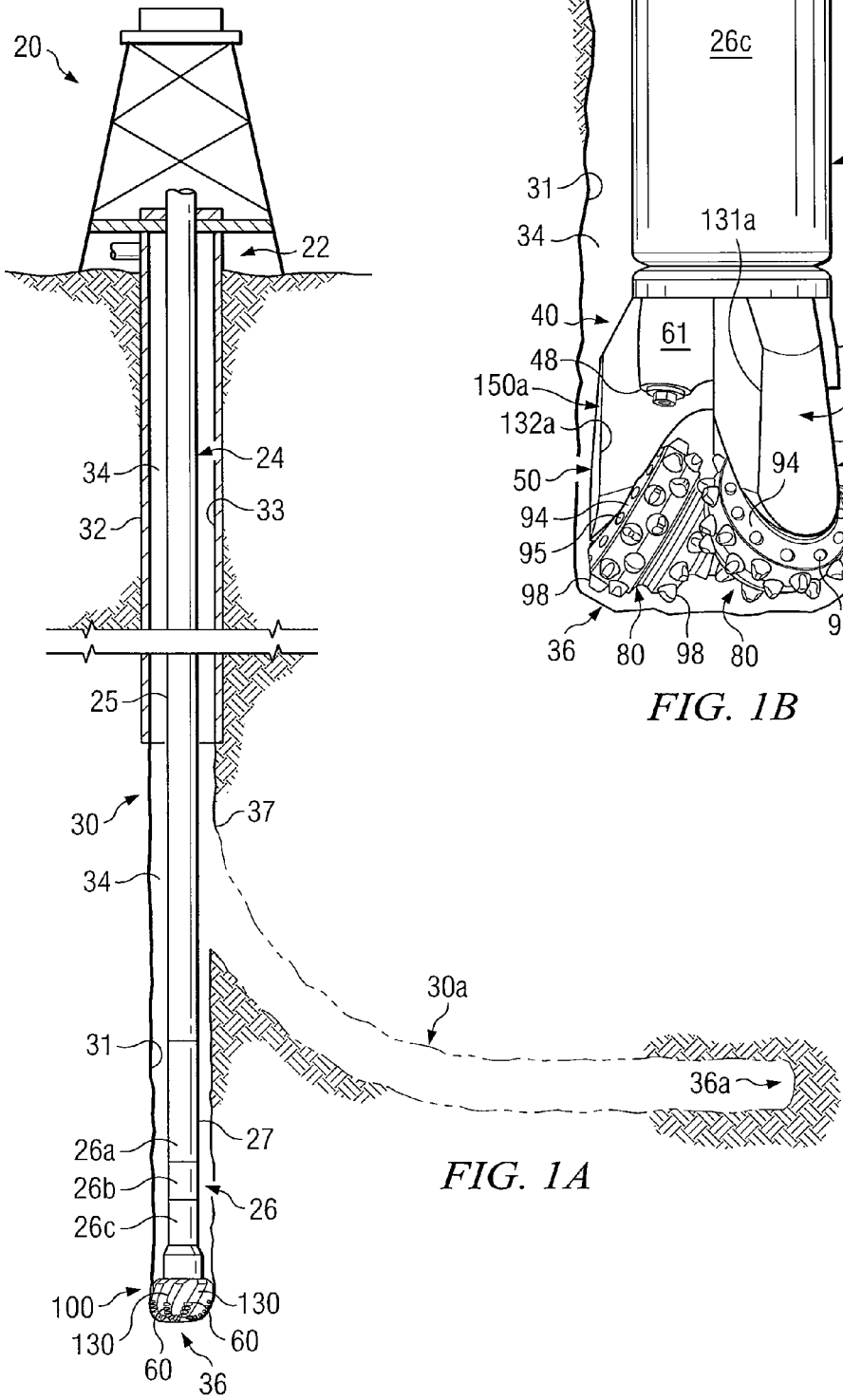
FIG. 1A is a schematic drawing in section and in elevation with portions broken away showing examples of wellbores which may be formed by a rotary drill bit incorporating teachings of the present disclosure.

Preferred embodiments of the disclosure and its advantages are best understood by reference to FIGS. 1-12F wherein like number refer to same and like parts.

The term "bottom hole assembly" or "BHA" be used in this application to describe various components and assemblies disposed proximate a rotary drill bit at the downhole end of a drill string. Examples of components and assemblies (not expressly shown) which may be included in a bottom hole assembly or BHA include, but are not limited to, a bent sub, a downhole drilling motor, a near bit reamer, stabilizers and downhole instruments. A bottom hole assembly may also include various types of well logging tools (not expressly shown) and other downhole tools associated with directional drilling of a wellbore. Examples of such logging tools and/or directional drilling tools may include, but are not limited to, acoustic, neutron, gamma ray, density, photoelectric, nuclear magnetic resonance, rotary steering tools and/or any other commercially available well tool.

The terms "cutting element" and "cutting elements" may be used in this application to include, but are not limited to, various types of cutters, compacts, buttons, inserts and gage cutters satisfactory for use with a wide variety of rotary drill bits. Impact arrestors may be included as part of the cutting structure on some types of rotary drill bits and may sometimes function as cutting elements to remove formation materials from adjacent portions of a wellbore. Polycrystalline diamond compacts (PDC) and tungsten carbide inserts are often used to form cutting elements. Various types of other hard, abrasive materials may also be satisfactorily used to form cutting elements.

The term "cutting structure" may be used in this application to include various combinations and arrangements of cutting elements, impact arrestors and/or gage cutters formed on exterior portions of a rotary drill bit. Some rotary drill bits may include one or more blades extending from an associated bit body with cutters disposed of the blades. Such blades may also be referred to as "cutter blades". Various configurations of blades and cutters may be used to form cutting structures for a rotary drill bit.

The terms "downhole" and "uphole" may be used in this application to describe the location of various components of a rotary drill bit relative to portions of the rotary drill bit which engage the bottom or end of a wellbore to remove adjacent formation materials. For example an "uphole" component may be located closer to an associated drill string or bottom hole assembly as compared to a "downhole" component which may be located closer to the bottom or end of the wellbore.

The term "gage pad" as used in this application may include a gage, gage segment, gage portion or any other portion of a rotary drill bit incorporating teachings of the present disclosure. Gage pads may be used to define or establish a generally uniform inside diameter of a wellbore formed by an associated rotary drill bit. A gage, gage segment, gage portion or gage pad may include one or more layers of hardfacing material. One or more gage cutters, gage inserts, gage compacts or gage buttons may be disposed on or adjacent to a gage, gage segment, gage portion or gage pad in accordance with teachings of the present disclosure. Gage pads incorporating teachings of the present disclosure may be disposed on a wide variety of rotary drill bit and other components of a bottom hole assembly and/or drill string. Rotating and non-rotating sleeves associated with directional drilling systems may also include such gage pads.

The term "rotary drill bit" may be used in this application to include various types of fixed cutter drill bits, drag bits, matrix drill bits, steel body drill bits, roller cone drill bits, rotary cone drill bits and rock bits operable to form a wellbore extending through one or more downhole formations. Rotary drill bits and associated components formed in accordance with teachings of the present disclosure may have many different designs, configurations and/or dimensions.

The terms "axial taper" or "axially tapered" may be used in this application to describe various portions of a gage pad disposed at an angle relative to an associated bit rotational axis. During drilling of a straight, vertical wellbore, an axial taper may sometimes be described as a "longitudinal" taper. An axially tapered portion of a gage pad may also be disposed at an angle extending longitudinally relative to adjacent portions of a straight wellbore.

Prior art axially tapered gage pads typically have an uphole edge disposed at a first, generally uniform radius extending from an associated bit rotational axis and a downhole edge disposed at a second, generally uniform radius extending from the associated bit rotational axis. An axially tapered gage pad formed in accordance with teachings of the present disclosure may include an uphole edge and/or a downhole edge which do not include a generally uniform radius extending from an associated bit rotational axis. As discussed later in more detail, for some embodiments the uphole edge and/or downhole edge of a gage pad may be formed with a variable radius or nonuniform radius extending from an associated bit rotational axis.

Figure 10A:
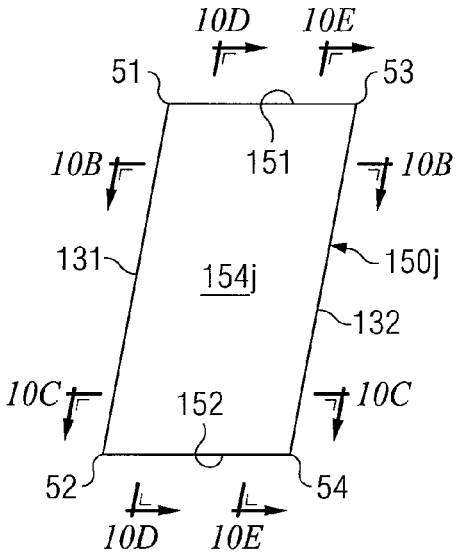
FIG. 10A is a schematic drawing showing a side view of one example of a gage pad having a generally positive radial taper angle and a generally positive axial taper angle incorporating teachings of the present disclosure.
Figure 10B:
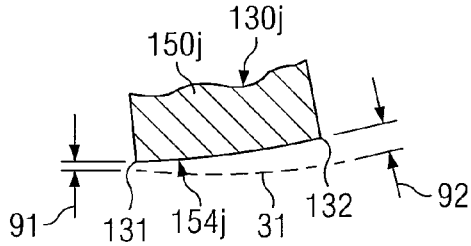
FIG. 10B is a schematic drawing taken along lines 10B-10B of FIG. 10A.
Figure 10C:
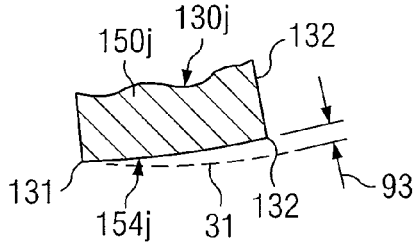
FIG. 10C is a schematic drawing in section taken along lines 10C-10C of FIG. 10A.
Figure 10D:
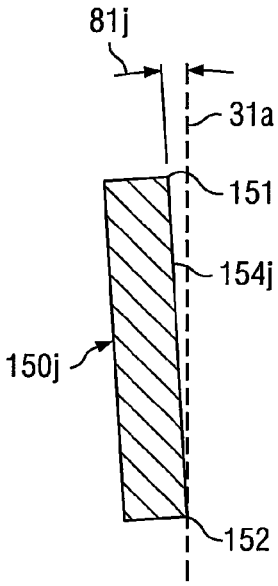
FIG. 10D is a schematic drawing in section taken along lines 10D-10D of FIG. 10A.
Figure 10E:
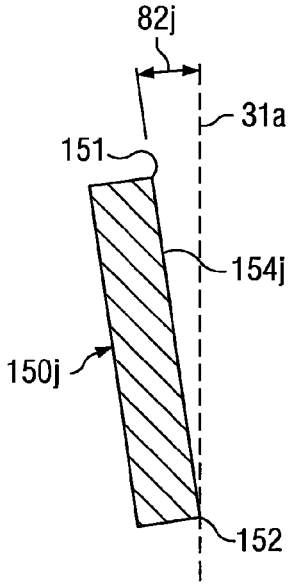
FIG. 10E is a schematic drawing in section taken along lines 10E-10E of FIG. 10A.
Figure 10F:
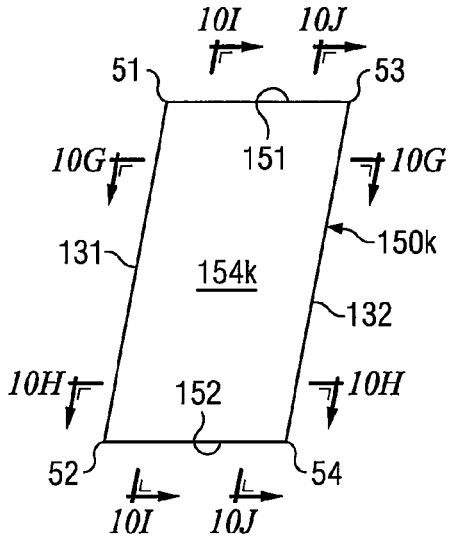
FIG. 10F is a schematic drawing showing a side view of one example of a gage pad having a generally negative radial taper angle and a generally negative axial taper angle incorporating teachings of the present disclosure.
Figure 10G:
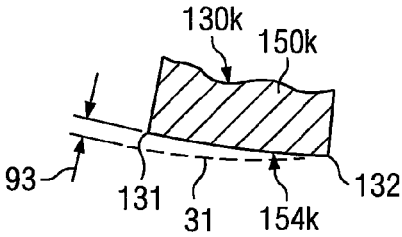
FIG. 10G is a schematic drawing taken along lines 10G-10G of FIG. 10F.
Figure 10H:
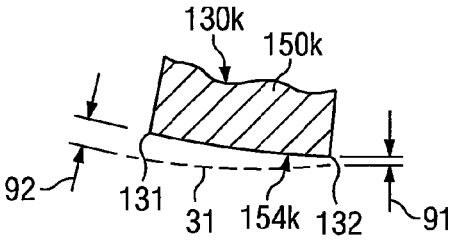
FIG. 10H is a schematic drawing in section taken along lines 10H-10H of FIG. 10F.
Figure 10I:
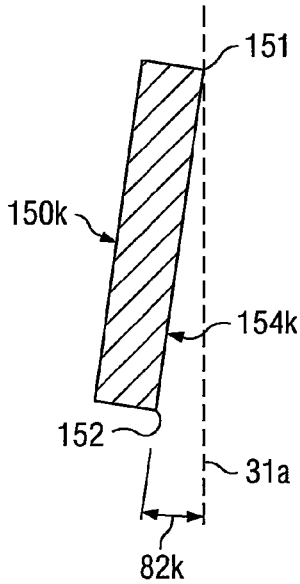
FIG. 10I is a schematic drawing in section taken along lines 10I-10I of FIG. 10F.
Figure 10J:
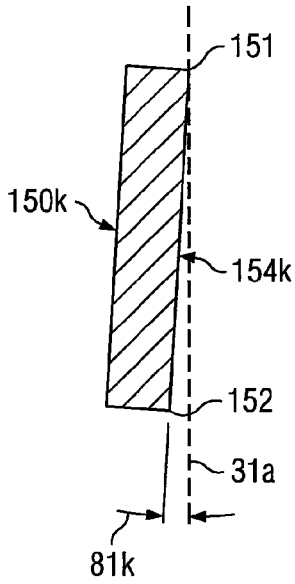
FIG. 10J is schematic drawing in section taken along lines 10J-10J of FIG. 10F.

A positive axial taper of a gage pad may result at least in part from a first radius of an uphole edge of the gage pad being smaller than a second radius of the downhole edge of the gage pad. A negative axial taper of a gage pad may result at least in part from the first radius of an uphole edge of the gage pad being larger than a second radius of the downhole edge of the gage pad. See for example FIGS. 4 AND 5. Additional examples of gage pads with generally positive axial taper angles are shown in FIGS. 10D and 10E. Additional examples of gage pads with generally negative axial taper angles are shown in FIGS. 10I and 10J.

Exterior portions of prior art gage pads may be disposed at a generally uniform angle, either positive, negative or parallel, relative to adjacent portions of a straight wellbore. The uphole edge of such prior art gage pads with a positive axial taper will generally be located further from adjacent portions of a straight wellbore. The downhole edge of prior art gage pads with a positive axial taper will generally be located closer to adjacent portions of the straight wellbore. The uphole edge of prior art gage pads with a negative axial taper angle will generally be located closer to adjacent portions of a straight wellbore. The downhole edge of prior art gage pads with a negative taper angle will be generally located at a greater distance from adjacent portions of a straight wellbore.

Figure 7A:
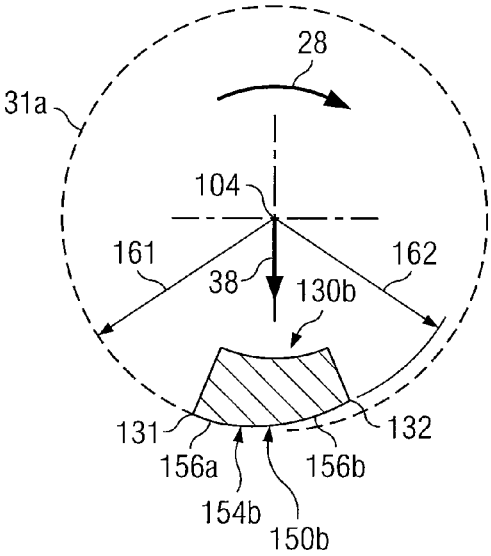
FIG. 7A is a schematic drawing in section with portions broken away showing one example of a blade and associated gage pad with a positive radial taper angle disposed on a rotary drill bit in accordance with teachings of the present disclosure.
Figure 7B:
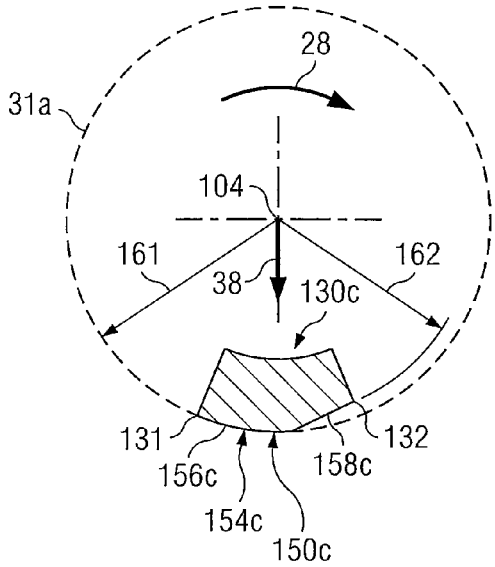
FIG. 7B is a schematic drawing in section with portions broken away showing another example of a blade and associated gage pad with a positive radial taper angle disposed on a rotary drill bit in accordance with teachings of the present disclosure.
Figure 7C:
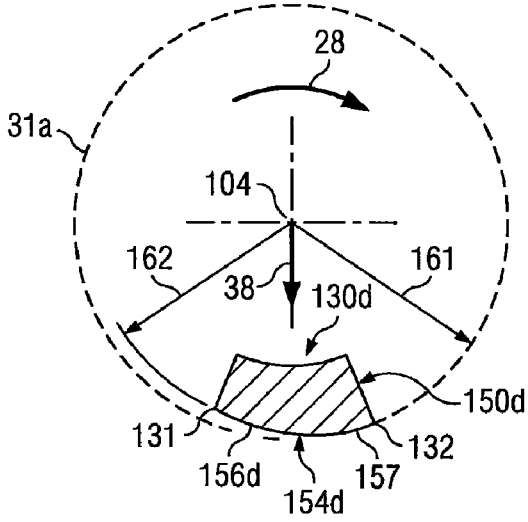
FIG. 7C is a schematic drawing in section with portions broken away showing a further example of a blade and associated gage pad with a negative radial taper angle disposed on a rotary drill bit in accordance with teachings of the present disclosure.
Figure 7D:
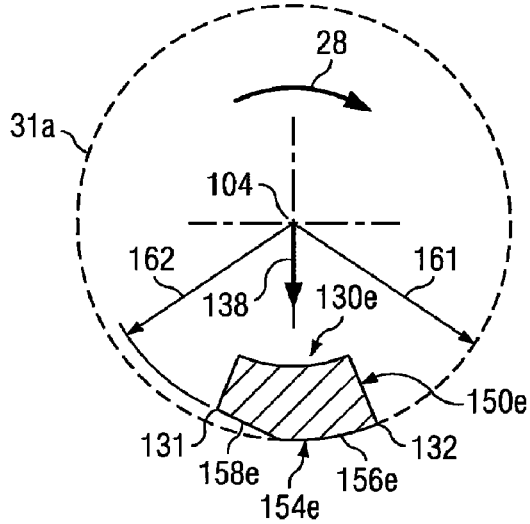
FIG. 7D is a schematic drawing in section with portions broken away showing still another example of a blade and associated gage pad with a negative radial taper angle disposed on a rotary drill bit in accordance with teachings of the present disclosure.

The terms "radially tapered", "radial taper" and/or "tangent taper" may be used in this application to describe exterior portions of a gage pad disposed at varying radial distances from an associated bit rotational axis. Each radius associated with radially tapered or tangent tapered exterior portions of a gage pad may be measured in a plane extending generally perpendicular to the associated bit rotational axis and intersecting the radially tapered or tangent tapered exterior portion of the gage pad. Examples of gage pads with generally positive radial taper angles are shown in FIGS. 7A and 7B. Examples of gage pads with generally negative radial taper angles are shown in FIGS. 7C and 7D.

Teachings of the present disclosure may be used to optimize the design of various features of a rotary drill bit including, but not limited to, the number of blades or cutter blades, dimensions and configurations of each cutter blade, configuration and dimensions of one or more support arms of a roller cone drill bit, configuration and dimensions of cutting elements, the number, location, orientation and type of cutting elements, gages (active or passive), length of one or more gage pads, orientation of one or more gage pads and/or configuration of one or more gage pads.

Rotary drill bits formed in accordance with teachings of the present disclosure may have a "passive gage" and an "active gage". An active gage may partially cut into and remove formation materials from adjacent portions or sidewall of an associated wellbore or borehole. A passive gage will generally not remove formation materials from the sidewall of an associated wellbore or borehole. During directional drilling of a wellbore, active gages frequently remove some formation materials from adjacent portions of a non-straight wellbore. A passive gage may plastically or elastically deform formation materials in a sidewall, particularly during directional drilling of an associated wellbore.

Various computer programs and computer models may be used to design gage pads, compacts, cutting elements, blades and/or associated rotary drill bits in accordance with teachings of the present disclosure. Examples of such methods and systems which may be used to design and evaluate performance of cutting elements and rotary drill bits incorporating teachings of the present disclosure are shown in copending U.S. patent applications entitled "Methods and Systems for Designing and/or Selecting Drilling Equipment Using Predictions of Rotary Drill Bit Walk," application Ser. No. 11/462,898, filing date Aug. 7, 2006; copending U.S. patent application entitled "Methods and Systems of Rotary Drill Bit Steerability Prediction, Rotary Drill Bit Design and Operation," application Ser. No. 11/462,918, filed Aug. 7, 2006 and copending U.S. patent application entitled "Methods and Systems for Design and/or Selection of Drilling Equipment Based on Wellbore Simulations," application Ser. No. 11/462,929, filing date Aug. 7, 2006. The previous copending patent applications and any resulting U.S. patents are incorporated by reference in this application.

Various aspects of the present disclosure may be described with respect to rotary drill bits 100 and 100*a* as shown in FIGS. 1-5. Rotary drill bits 100 and 100*a* may also be described as fixed cutter drill bits. Various aspects of the present disclosure may also be used to design roller cone or rotary cone drill bits for optimum downhole drilling performance.

Rotary drill bits 100 and/or 100*a* may be modified to include various types of gages, gage segments, gage portions and/or gage pads incorporating teachings of the present disclosure. Also, a wide variety of rotary drill bits may be formed with gages, gage pads, gage segments and/or gage portions incorporating teachings of the present disclosure. The scope of the present disclosure is not limited to rotary drill bits 100 or 100*a*. The scope of the present disclosure is also not limited to gage pads such as shown in FIGS. 7A-12F.

FIG. 1A is a schematic drawing in elevation and in section with portions broken away showing examples of wellbores or bore holes which may be formed by rotary drill bits incorporating teachings of the present disclosure. Various aspects of the present disclosure may be described with respect to drilling rig 20 rotating drill string 24 and attached rotary drill bit 100 to form a wellbore.

Various types of drilling equipment such as a rotary table, mud pumps and mud tanks (not expressly shown) may be located at well surface or well site 22. Drilling rig 20 may have various characteristics and features associated with a "land drilling rig." However, rotary drill bits incorporating teachings of the present disclosure may be satisfactorily used with drilling equipment located on offshore platforms, drill ships, semi-submersibles and drilling barges (not expressly shown).

For some applications rotary drill bit 100 may be attached to bottom hole assembly 26 at an extreme end of drill string 24. Drill string 24 may be formed from sections or joints of generally hollow, tubular drill pipe (not expressly shown). Bottom hole assembly 26 will generally have an outside diameter compatible with exterior portions of drill string 24.

Bottom hole assembly 26 may be formed from a wide variety of components. For example components 26*a*, 26*b* and 26*c* may be selected from the group consisting of, but not limited to, drill collars, rotary steering tools, directional drilling tools and/or downhole drilling motors. The number of components such as drill collars and different types of components included in a bottom hole assembly will depend upon anticipated downhole drilling conditions and the type of wellbore which will be formed by drill string 24 and rotary drill bit 100.

Drill string 24 and rotary drill bit 100 may be used to form a wide variety of wellbores and/or bore holes such as generally vertical wellbore 30 and/or generally horizontal wellbore 30*a* as shown in FIG. 1A. Various directional drilling techniques and associated components of bottomhole assembly 26 may be used to form horizontal wellbore 30*a*. For example lateral forces may be applied to rotary drill bit 100 proximate kickoff location 37 to form horizontal wellbore 30*a* extending from generally vertical wellbore 30. Such lateral movement of rotary drill bit 100 may be described as "building" or forming a wellbore with an increasing angle relative to vertical. Bit tilting may also occur during formation of horizontal wellbore 30*a*, particularly proximate kickoff location 37.

Wellbore 30 may be defined in part by casing string 32 extending from well surface 22 to a selected downhole location. Portions of wellbore 30 as shown in FIG. 1A which do not include casing 32 may be described as "open hole". Various types of drilling fluid may be pumped from well surface 22 through drill string 24 to attached rotary drill bit 100. The drilling fluid may be circulated back to well surface 22 through annulus 34 defined in part by outside diameter 25 of drill string 24 and inside diameter 31 of wellbore 30. Annulus 34 may also be defined by outside diameter 25 of drill string 24 and inside diameter 31 of casing string 32.

Inside diameter 31 may sometimes be referred to as the "sidewall" of wellbore 30. Inside diameter 31 may often correspond with a nominal diameter or nominal outside diameter associated with rotary drill bit 100. However, depending upon downhole drilling conditions, the amount of wear on one or more components of a rotary drill bit and variations between nominal diameter bit and as build dimensions of a rotary drill bit, a wellbore formed by a rotary drill bit may have an inside diameter which may be either larger than or smaller than the corresponding nominal bit diameter. Therefore, various diameters and other dimensions associated with gage pads formed in accordance with teachings of the present disclosure may be defined with respect to an associated bit rotational axis and not the inside diameter of a wellbore formed by an associated rotary drill bit.

Nominal bit diameter may sometimes be referred to as "nominal bit size" or "bit size." The American Petroleum Institute (API) publishes various standards related to nominal bit size, clearance diameters and casing dimensions.

Formation cuttings may be formed by rotary drill bit 100 engaging formation materials proximate end 36 of wellbore 30. Drilling fluids may be used to remove formation cuttings and other downhole debris (not expressly shown) from end 36 of wellbore 30 to well surface 22. End 36 may sometimes be described as "bottom hole" 36. Formation cuttings may also be formed by rotary drill bit 100 engaging end 36*a* of horizontal wellbore 30*a*.

As shown in FIG. 1A, drill string 24 may apply weight to and rotate rotary drill bit 100 to form wellbore 30. Inside diameter or sidewall 31 of wellbore 30 may correspond approximately with the combined outside diameter of blades 130 and associated gage pads 150 extending from rotary drill bit 100. Rate of penetration (ROP) of a rotary drill bit is typically a function of both weight on bit (WOB) and revolutions per minute (RPM). For some applications a downhole motor (not expressly shown) may be provided as part of bottom hole assembly 26 to also rotate rotary drill bit 100. The rate of penetration of a rotary drill bit is generally stated in feet per hour.

In addition to rotating and applying weight to rotary drill bit 100, drill string 24 may provide a conduit for communicating drilling fluids and other fluids from well surface 22 to drill bit 100 at end 36 of wellbore 30. Such drilling fluids may be directed to flow from drill string 24 to respective nozzles provided in rotary drill bit 100. See for example nozzle 56 in FIG. 3.

Bit body 120 will often be substantially covered by a mixture of drilling fluid, formation cuttings and other downhole debris while drilling string 24 rotates rotary drill bit 100. Drilling fluid exiting from one or more nozzles 56 may be directed to flow generally downwardly between adjacent blades 130 and flow under and around lower portions of bit body 120.

The term "roller cone drill bit" may be used in this application to describe any type of rotary drill bit having at least one support arm with a cone assembly rotatably mounted thereon. Roller cone drill bits may sometimes be described as "rotary cone drill bits," "cutter cone drill bits" or "rotary rock bits". Roller cone drill bits often include a bit body with three support arms extending therefrom and a respective cone assembly rotatably mounted on each support arm. However, teachings of the present disclosure may be satisfactorily used with rotary drill bits having one support arm, two support arms or any other number of support arms and associated cone assemblies.

Figure 1B:
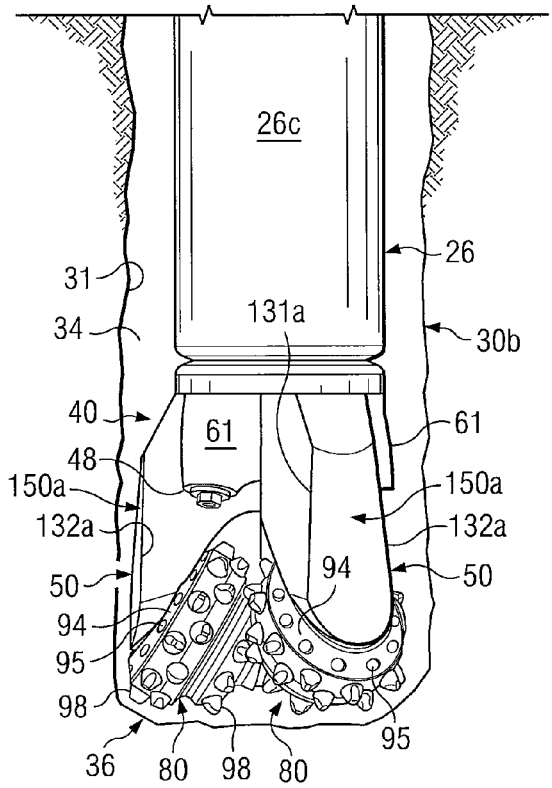
FIG. 1B is a schematic drawing in section and in elevation with portions broken away showing another example of a rotary drill bit incorporating teachings of the present disclosure.

FIG. 1B is a schematic drawing in elevation and in section with portions broken away showing one example of roller cone drill bit incorporating teachings of the present disclosure disposed in a wellbore. Roller cone drill bit 40 as shown in FIG. 1B may be attached with the end of drill string 24 extending from well surface 22. Roller cone drill bits such as rotary drill bit 40 typically form wellbores by crushing or penetrating a formation and scraping or shearing formation materials from the bottom of the wellbore using cutting elements which often produce a high concentration of fine, abrasive particles.

Bit body 61 may be formed from three segments which include respective support arms 50 extending therefrom. The segments may be welded with each other using conventional techniques to form bit body 61. Only two support arms 50 are shown in FIG. 1B.

Each support arm 50 may be generally described as having an elongated configuration extending from bit body 61. Each support arm may include a respective spindle (not expressly shown) with a respective cone assembly 80 rotatably melded thereon. Each support arm 50 may include respective leading edge 131*a* and trailing edge 132*a*. Each support arm 150 may also include a respective gage pad 150*a* formed in accordance with teachings of the present disclosure.

Cone assemblies 80 may have an axis of rotation corresponding generally with the angularly shaped relationship of the associated spindle and respective support arm 50. The axis of rotation of each cone assembly 80 may generally correspond with the longitudinal axis of the associated spindle. The axis of rotation of each cone assembly 80 may be offset relative to the longitudinal axis or bit rotational axis associated with roller cone drill bit 40.

For some applications a plurality of compacts 95 may be disposed on backface 94 of each cone assembly 90. Compacts 95 may reduce wear of backface 94.

Each cone assembly 80 may include a plurality of cutting elements 98 arranged in respective rows disposed on exterior portions of each cone assembly 80. Compacts 95 and cutting elements 98 may be formed from a wide variety of materials such as tungsten carbide or other hard materials satisfactory for use in forming a roller cone drill bit. For some applications compacts 95 and/or inserts 96 may be formed at least in part from polycrystalline diamond-type materials and/or other hard, abrasive materials.

Figure 2:
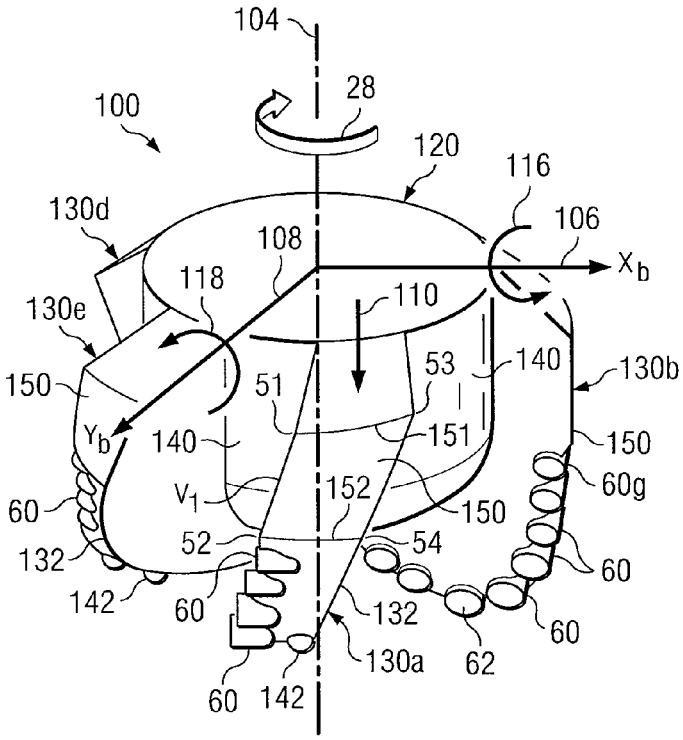
FIG. 2 is a schematic drawing showing an isometric view with portions broken away of a rotary drill bit.
Figure 3:
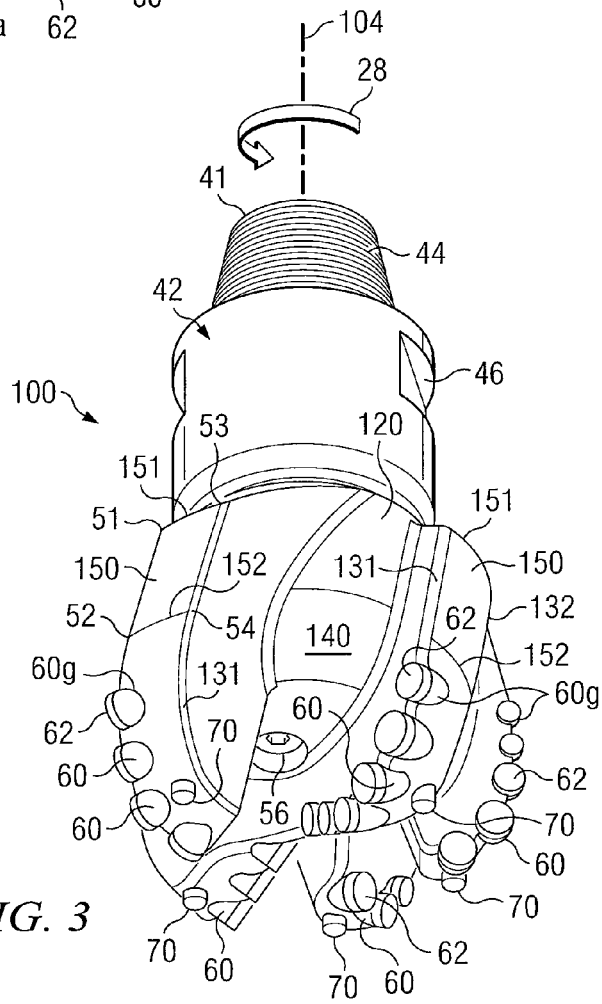
FIG. 3 is a schematic drawing showing an isometric view of another example of a rotary drill bit.

FIGS. 2 and 3 are schematic drawings showing additional details of rotary drill bit 100 which may include at least one gage, gage portion, gage segment or gage pad incorporating teachings of the present disclosure. Rotary drill bit 100 may include bit body 120 with a plurality of blades 130 extending therefrom. For some applications bit body 120 may be formed in part from a matrix of very hard materials associated with rotary drill bits. For other applications bit body 120 may be machined from various metal alloys satisfactory for use in drilling wellbores in downhole formations. Examples of matrix type drill bits are shown in U.S. Pat. Nos. 4,696,354 and 5,099,929.

Bit body 120 may also include upper portion or shank 42 with American Petroleum Institute (API) drill pipe threads 44 formed thereon. API threads 44 may be used to releasably engage rotary drill bit 100 with bottomhole assembly 26 whereby rotary drill bit 100 may be rotated relative to bit rotational axis 104 in response to rotation of drill string 24. Bit breaker slots 46 may also be formed on exterior portions of upper portion or shank 42 for use in engaging and disengaging rotary drill bit 100 from an associated drill string.

An enlarged bore or cavity (not expressly shown) may extend from end 41 through upper portion 42 and into bit body 120. The enlarged bore may be used to communicate drilling fluids from drill string 24 to one or more nozzles 56. A plurality of respective junk slots or fluid flow paths 140 may be formed between respective pairs of blades 130. Blades 130 may spiral or extend at an angle relative to associated bit rotational axis 104.

One of the benefits of the present disclosure may include designing at least one gage pad based on parameters such as blade length, blade width, blade spiral, axial taper, radial taper and/or other parameters associated with rotary drill bits. Various features of such gage pads may be defined relative to the bit rotational axis of an associated rotary drill bit and not the inside diameter of a wellbore formed by the associated rotary drill bit. Gage pads incorporating teachings of the present disclosure may be disposed on various components of rotary drill string such as, but not limited to, sleeve, reamers, bottomhole assemblies and other downhole tools. Various features of such gage pad may also be defined relative to an associated rotation axis or longitudinal axis.

A plurality of cutting elements 60 may be disposed on exterior portions of each blade 130. For some applications each cutting element 60 may be disposed in a respective socket or pocket formed on exterior portions of associated blades 130. Impact arrestors and/or secondary cutters 70 may also be disposed on each blade 130. See for example, FIG. 3.

Cutting elements 60 may include respective substrates (not expressly shown) with respective layers 62 of hard cutting material disposed on one end of each respective substrate. Layer 62 of hard cutting material may also be referred to as "cutting layer" 62. Each substrate may have various configurations and may be formed from tungsten carbide or other materials associated with forming cutting elements for rotary drill bits. For some applications cutting layers 62 may be formed from substantially the same hard cutting materials. For other applications cutting layers 62 may be formed from different materials.

Various parameters associated with rotary drill bit 100 may include, but are not limited to, location and configuration of blades 130, junk slots 140 and cutting elements 60. Each blade 130 may include respective gage portion or gage pad 150. For some applications gage cutters may also be disposed on each blade 130. See for example gage cutters 60*g*. Additional information concerning gage cutters and hard cutting materials may be found in U.S. Pat. Nos. 7,083,010, 6,845,828, and 6,302,224. Additional information concerning impact arrestors may be found in U.S. Pat. Nos. 6,003,623, 5,595,252 and 4,889,017.

Rotary drill bits are generally rotated to the right during formation of a wellbore. See respective arrows 28 in FIGS. 2, 3, 4, 6A, 7A-7D. 8A and 8B. Cutting elements and/or blades may be generally described as "leading" or "trailing" with respect to other cutting elements and/or blades disposed on the exterior portions of an associated rotary drill bit. For example blade 130*a* as shown in FIG. 2 may be generally described as leading blade 130*b* and may be generally described as trailing blade 130*e*. In the same respect cutting elements 60 disposed on blade 130*a* may be described as leading corresponding cutting element 60 disposed on blade 130*b*. Cutting elements 60 disposed on blade 130*a* may be generally described as trailing cutting elements 60 disposed on blade 130*e*.

Figure 4:
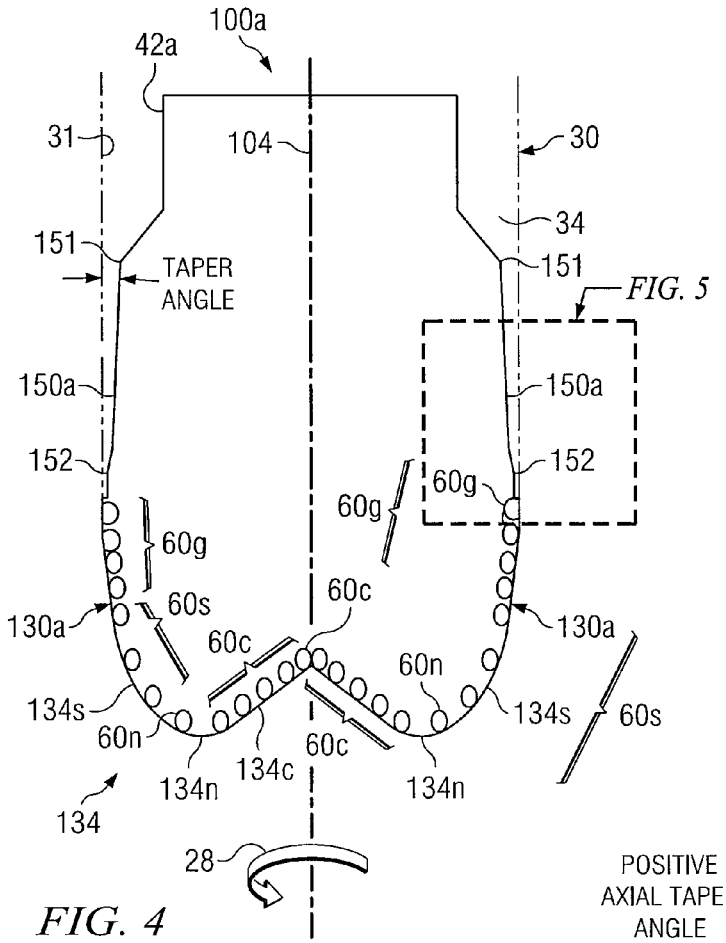
FIG. 4 is a schematic drawing in section with portions broken away showing still another example of a rotary drill bit.
Figure 5:
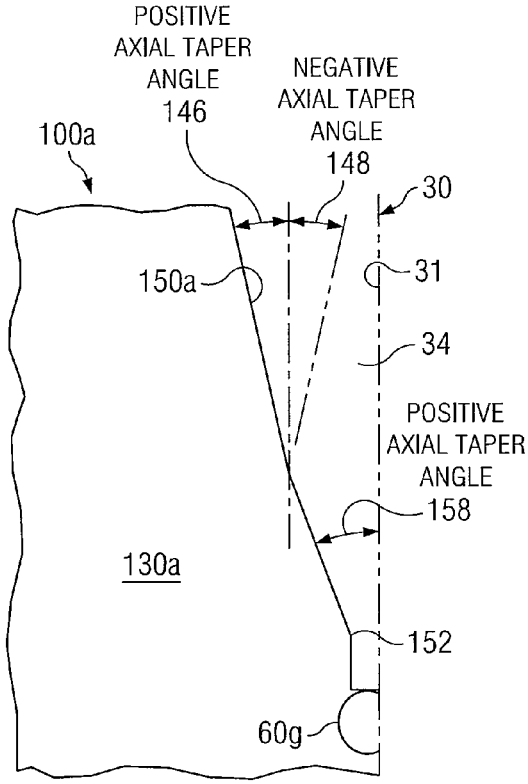
FIG. 5 is a schematic drawing in section with portions broken away showing an enlarged view of a gage portion of one blade on the rotary drill bit shown in FIG. 4.

Rotary drill bit 100*a* as shown in FIGS. 4 and 5 may be described as having a plurality of blades 130*a* with a plurality of cutting elements 60 disposed on exterior portions of each blade 130*a*. For some applications cutting elements 60 may have substantially the same configuration and design. For other applications various types of cutting elements and impact arrestors (not expressly shown) may also be disposed on exterior portions of blades 130*a*.

Exterior portions of blades 130*a* and associated cutting elements 60 may be described as forming a "bit face profile" for rotary drill bit 100*a*. Bit face profile 134 of rotary drill bit 100*a* as shown in FIG. 4 may include recessed portions or cone shaped segments 134*c* formed on rotary drill bit 100*a* opposite from shank 42*a*. Each blade 130*a* may include respective nose portions or segments 134*n* which define in part an extreme end of rotary drill bit 100*a* opposite from shank 42*a*. Cone shaped segments 134*c* may extend radially inward from respective nose segments 134*n* toward bit rotational axis 104. A plurality of cutting elements 60*c* may be disposed on recessed portions or cone shaped segments 134*c* of each blade 130*a* between respective nose segments 134*n* and rotational axis 104*a*. A plurality of cutting elements 60*n* may be disposed on nose segments 134*n*.

Each blade 130*a* may also be described as having respective shoulder segment 134*s* extending outward from respective nose segment 134*n*. A plurality of cutting elements 60*s* may be disposed on each shoulder segment 134*s*. Cutting elements 60*s* may sometimes be referred to as "shoulder cutters." Shoulder segments 134*s* and associated shoulder cutters 60*s* may cooperate with each other to form portions of bit face profile 134 of rotary drill bit 100*a* extending outward from nose segments 134*n*.

A plurality of gage cutters 60*g* may also be disposed on exterior portions of each blade 130*a* proximate respective gage pad 150*a*. Gage cutters 60*g* may be used to trim or ream inside diameter or sidewall 31 of wellbore 30.

As shown in FIGS. 4 and 5 each blade 130*a* may include respective gage pad 150*a*. Various types of hardfacing and/or other hard materials (not expressly shown) may be disposed on exterior portions of each gage pad 150*a*. Each gage pad 150*a* may include generally positive axial taper 146 or generally negative axial taper 148 as shown in FIG. 5.

Figure 6A:
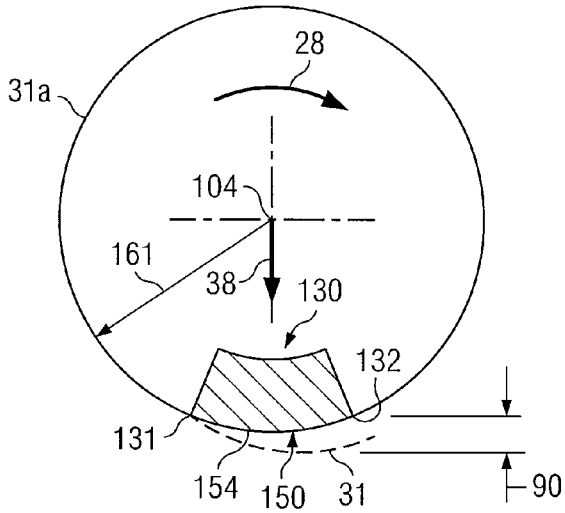
FIG. 6A (PRIOR ART)
FIG. 6A is a schematic drawing in section showing one example of a prior art blade and associated gage pad on a rotary drill bit.
Figure 6B:
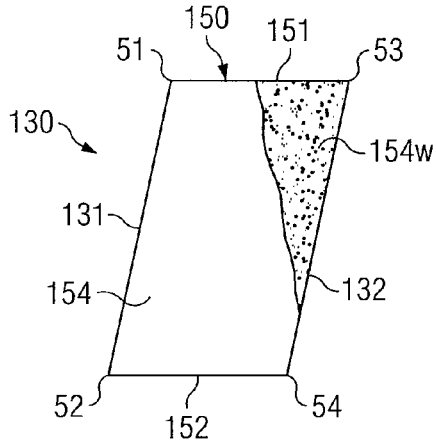
FIG. 6B (PRIOR ART)
FIG. 6B is a schematic drawing showing an isometric side view of the gage pad of FIG. 6A.

Various types of gage pads may be disposed on one or more blades of rotary drill bits 100 and 100*a*. FIGS. 6A and 6B show one example of a prior art gage pad which may be formed on blades 130 or 130*a*. FIGS. 7A-12F show examples of blades and gage pads incorporating teachings of the present disclosure which may be disposed on rotary drill bit 100, rotary drill bit 100*a* or other rotary drill bit as desired to improve performance of such drill bits. Gage pads may be formed on rotary drill bit 100, rotary drill bit 100*a* or other rotary drill bits in accordance with teachings of the present disclosure.

Gage pads generally include respective uphole edge 151 disposed generally adjacent to an associated upper portion or shank. See for example upper portion 42 in FIG. 3 or upper portion 42*a* in FIG. 4. Gage pads generally include respective downhole edge 152. For some applications downhole edge 152 may be clearly defined such as downhole edge 152 as shown on blade 130*a* in FIG. 5. For other applications downhole edge 152 associated with gage pad 150 may represent a change from a generally non-curved surface to a curved surface disposed on exterior portion of each blade 130. See dotted line 152 in FIG. 3.

Gage pads may also include respective leading edge 131 and trailing edge 132 extending downhole from associated uphole edge 151. Leading edge 131 of each gage pad 150 or 150*a* may extend from corresponding leading edge 131 of associated blade 130 or 130*a*. Trailing edge 132 of each gage pad 150 or 150*a* may extend from corresponding trailing edge 132 of associated blade 130 or 130*a*.

For purposes of describing various features of a gage pad, reference may be made to four points or locations (51, 52, 53 and 54) disposed on exterior portions of the gage pad. Point 51 may generally correspond with the intersection of respective uphole edge 151 and respective portions of leading edge 131. Point 53 may generally correspond with the intersection of respective uphole edge 151 and respective portions of trailing edge 132. Point 52 may generally correspond with the intersection of respective downhole edge 152 and respective portions of leading edge 131. Point 54 may generally correspond with respective downhole edge 152 and respective portions of trailing edge 132.

FIGS. 6A and 6B are schematic drawings which may be used to describe a rotary drill bit including, but not limited to, rotary drill bit 100 having conventional or prior art gage pads 150 disposed on respective blades 130. Gage pads 150 may be formed with substantially no axial taper, no radial taper and no radial offset relative to bit rotational axis 104 and adjacent portions of a straight wellbore formed by rotary drill bit 100. Exterior surface 154 of gage pad 150 may be defined by radius 161 extending from associated bit rotation axis 104.

Circle 31*a* as shown in FIG. 6A may represent nominal bit size or nominal bit diameter ($D_b$) of rotary drill bit 100 relative to bit rotational axis 104. Arrow 28 may represent the direction of rotation of rotary drill bit 100 during formation of a wellbore. Circle 31*a* as shown in FIG. 6A may often correspond generally with inside diameter 31 of wellbore 30 adjacent to kickoff location 37. See FIG. 1A. Circles 31*a* as shown in FIGS. 6A, 7A, 7B, 7C, 7D, 8A and 8B may often represent the nominal bit diameter of the associated rotary drill bit measured relative to respective bit rotational axis 104. As previously noted, the inside diameter of a wellbore formed by a rotary drill bit may sometimes have an inside diameter larger than or smaller than the nominal diameter or nominal size of the rotary drill bit.

One or more components in bottomhole assembly 26 may direct or guide rotary drill bit 100 to form horizontal wellbore 30*a* extending laterally from wellbore 30 proximate kickoff location 37. Arrow 38 may indicate the direction of lateral penetration of rotary drill bit 100 required to form wellbore 30*a* extending from kickoff location 37. Dotted line 31*a* as shown in FIG. 6A may represent incremental lateral movement during one revolution of rotary drill bit 100 to form non-straight or curve segments of wellbore 30*a*. Such lateral movement of rotary drill bit 100 will typically result in increased contact between exterior portion 154 of gage pad 150 adjacent to trailing edge 132 as compared with contact occurring at leading edge 131.

For some applications, the amount of penetration of gage pad 154 at leading edge 131 may be assumed to be approximately equal to zero. Exterior portions 154 of gage pad 150 adjacent to trailing edge 132 may penetrate adjacent portions of a wellbore during each revolution of rotary drill bit 100 by distance 90 as shown in FIG. 6A during lateral penetration of a wellbore. Such increased lateral penetration across exterior portion 154 of gage pad 150 may frequently increase wear on exterior portion 154 of gage pad 150 adjacent to uphole edge 151 and trailing edge 132. See for example wear zone 154*w* in FIG. 6B.

The following formula may be used to estimate engagement depth of a gage pad resulting from side cutting or lateral penetration of a wellbore by an associated rotary drill bit. For a given lateral rate of penetration ($ROP_{lat}$), revolutions per minute (RPM), drill bit size or nominal bit diameter ($D_b$) and gage pad width (W), the following formula may be used to calculate estimated engagement depth of point 54 on downhole edge 152 of gage pad 150 during engagement and disengagement with the wellbore 31. See FIGS. 6A and 6B.

$$\Delta = ROP_{lat} \times dt$$

$$dt = \frac{1}{(6 \times RPM)} \times \frac{W}{\pi D_b}$$

A more accurate estimate of engagement depth of gage pad 150 into adjacent portions of the sidewall of a wellbore during one revolution of an associated rotary drill bit may be obtained by using actual dimensions of exterior 154 measured relative to respective bit rotational axis 104.

If $ROP_{lat}$ equals 15 ft/hr, nominal bit diameter ($D_b$) equals 12.5 inches and gage pad width equals 2.5 inches, the engagement depth of $P_B$ may equal 0.0032 inches or 0.0081 mm. Inspection of rotary drill bits having convention gage pads often show increased wear at location corresponding with wear zone 154*w* extending from point 53 and adjacent portions of downhole edge 152 and trailing edge 132. See FIG. 6B.

Gage pad width (W) may correspond approximately with the distance between the leading edge and the trailing edge of a gage pad measure relative to a plane extending perpendicular to a associated bit rotational axis and intersecting exterior portions of the associated gage pad. For example, the width of gage pad 150 along downhole edge 152 as shown in FIGS. 2 and 3 may correspond generally with the distance between associated point 52 and 54.

For some applications respective widths of a gage pad measured relative to an associated downhole edge and an associated uphole edge may generally be equal to each other. For other applications the width of a gage pad formed in accordance with teachings of the present disclosure may vary when measured along an associated downhole edge as compared with a width measured along an associated uphole edge.

Lateral movement of rotary drill bit 100 in the direction of arrow 38 may gradually increase across exterior portion 154 of gage pad 150 between leading edge 131 and trailing edge 132. As a result, prior art gage pads having approximately zero taper such as gage pads 150 as shown in FIGS. 2, 3, 6A and 6B may experience also increased wear adjacent to trailing edge 132.

Tilting of an associated rotary drill bit during formation of a directional or non-straight wellbore may also result in portions of exterior surface 154*w* adjacent to trailing edge 132 and uphole edge 151 having increased contact with adjacent portions of the directional or non-straight wellbore as compared with portions of exterior surface 154 adjacent to leading edge 131. Forming a rotary drill bit with gage pads having one or more tapered surfaces and/or recessed portions in accordance with teachings of the present disclosure may substantially minimize and/or reduce wear on exterior portions of the associated gage pads.

For embodiments such as shown in FIGS. 7A-12F uphole edge 151, downhole edge 152, leading edge 131 and trailing edge 132 may be generally described as forming a parallelogram. However, gage pads formed in accordance with teachings of the present disclosure may have perimeters with a wide variety of configurations including, but not limited to, square, rectangular or trapezoidal. The present disclosure is not limited to gage pads having configurations such as shown in FIGS. 7A-12F.

For some applications gage pads incorporating teachings of the present disclaimer may include leading edge 131 with relative uniform first radius 161 extending from bit rotation axis 104 between the associated uphole edge and downhole edge (not expressly shown). Trailing edge 132 of such gage pads may also have relatively uniform second radius 162 extending from bit rotational axis 104 between the associated uphole edge and downhole edge (not expressly shown). For other applications segments of leading edge 131 and/or trailing edge 132 of a gage pad incorporating teachings of the present disclosure may have varying radii extending from bit rotational axis 104. See for example FIGS. 7A, 7B, 7C, 7D, 8A, 8B, 10B, 10C, 10G and 10H.

Gage pads formed in accordance with teachings of the present disclosure may be active gages or passive gages as desired to optimize performance of an associated rotary drill bit. For some applications gage pads may be formed with respective leading edges having gage cutters, compacts, buttons and/or inserts operable to contact and remove formations materials from adjacent portions of a wellbore. Such gage pads may sometimes be referred to as "active gages". Examples of such active gage pads are shown in FIGS. 7C, 7D, 8A, 8B, 10E-10G, 11D, 11E, 12D and 12E. Steerability of a rotary drill bit having gage pads with active leading edges may be enhanced by forming respective negative radially tapered segments and/or negative axially tapered segments on exterior portions of such gage pads without significantly decreasing lateral stability of the rotary drill bit.

For some applications the respective uphole edge and respective downhole edge associated with each gage pad 150*a*-150*k* may have substantially the same configuration and dimensions relative to associated bit rotation axis 104. As a result, gage pads 150*a*-150*k* may have substantially zero axial taper. For other applications gage pads 150*a*-150*k* may be formed with a generally positive axial taper or a generally negative axial taper such as shown in FIG. 5.

Various features of the present disclosure may be described with respect to first radius 161 and second radius 162 extending from associated bit rotational axis 104. First radius 161 may correspond with approximately one half of nominal bit diameter ($D_b$) of an associated rotary drill bit depending upon various design details of the associated rotary drill bit, gage pads and/or cutting elements and cutting structure. Second radius 162 may help to describe various tapered portions of respective gage pads formed in accordance with teachings of the present disclosure. The length of second radius 162 may generally be shorter than the length of associated first radius 161.

For some applications the difference between first radius 161 and second radius 162 may be based at least in part on calculations of increased engagement experienced by exterior portions of an associated gage pad during lateral penetration of a wellbore. See FIGS. 6A and 6B. Such calculations may be used to determine optimum axial and/or radial taper angles to minimize wear of such gage pads, particularly when an associated rotary drill bit is forming non-straight segments of a wellbore. Designing exterior portions of a gage pad in accordance with teachings of the present disclosure with a shorter second radius 162 may increase radial taper angles of associated exterior portions of the gage pad. Increasing the length of second radius 162 may result in reducing associated radial taper angles.

FIGS. 7A-7D show respective examples of gage pads incorporating teachings of the present disclosure. Blades 130*b*, 130*c*, 130*d* and 130*e* may include respective gage pads 150*b*, 150*c*, 150*d* and 150*e* defined in part by respective leading edge 131 and trailing edge 132. Respective uphole and downhole edges associated with each gage pad 150*b*, 150*c*, 150*d* and 150*e* are not expressly shown. Each gage pad 150*b*, 150*c*, 150*d* and 150*e* may be generally described as having respective exterior radially tapered portions or tangent tapered portions. Each radially tapered portion or tangent tapered portion may further be described as having a respective positive radial taper angle (FIGS. 7A and 7B) or a respective negative radial taper angle (FIGS. 7C and 7D).

Exterior portion 154*b* of gage pad 150*b* as shown in FIG. 7A may be generally described as a continuous curved surface extending between associated leading edge 131 and trailing edge 132. Exterior portion 154*b* may include first curved segment 156*a* with relatively uniform radius 161 extending from associated bit rotational axis 104. Exterior portion 154*b* may include second curved segment 156*b* defined in part by a varying radius extending from associated bit rotational axis 104.

For embodiments such as shown in FIG. 7A, second curved segment 156*b* may have a radius approximately equal to first radius 161 adjacent to first curved segment 156*a*. The radius of second curved segment 156*b* may approximately equal second radius 162 adjacent to associated trailing edge 132. Second curved segment 156*b* may be generally described as a radially tapered segment with positive tangent taper angles relative to radii extending from associated bit rotational axis 104. For some applications a gage pad may be formed with an exterior portion having a continuous curved segment defined in part by varying radii as measured from an associated bit rotational axis between a leading edge of the gage pad to a trailing edge of the gage pad (not expressly shown).

Exterior portion 154*c* of gage pad 150*c* as shown in FIG. 7B may be generally described as including generally curved segment 156*c* extending from leading edge 131 toward trailing edge 132. Exterior portion 154*c* of gage pad 150*c* may also be generally described as having noncurved, straight segment 158*c* extending from trailing edge 132 towards leading edge 131. Generally curved segment 156*c* may intersect with noncurved, straight segment 158*c* between leading edge 131 and trailing edge 132.

For embodiments such as shown in FIG. 7B generally curved segment 156*c* may be disposed at a relatively uniform radius corresponding with radius 161 extending from associated bit rotational axis 104. For other applications (not expressly shown) generally curved segment 156*c* may include a radially tapered configuration similar to previously described radially tapered segment 156*b*.

Exterior portion 154*d* of gage pad 150*d* as shown in FIG. 7C may be generally described as a continuous curved surface extending between associated leading edge 131 and trailing edge 132. Exterior portion 154*c* may include first curved segment 156*d* extending from leading edge 131. First curved segment 156*d* may be defined in part by continually varying radii extending from associated bit rotational axis 104. For embodiments such as shown in FIG. 7C, first curve segment 156*d* may have a radius approximately equal to radius 162 adjacent to leading edge 131. The radius of first curve segment 156*d* may increase to approximately equal radius 161.

First curved segment 156*d* may also be referred to as a radially tapered segment. Radially tapered segment 156*d* may be further described as a continuous curved surface having generally negative tangent tapered angles relative to radii extending from associated bit rotational axis 104.

Exterior portion 154*d* may also include second curved segment 157 having a relatively uniform radius corresponding approximately with radius 161. Second curved segment 157 may extend from respective trailing edge 132 toward leading edge 131. First curved segment 156*d* and second curved segment 157 may intersect with each other intermediate leading edge 131 and trailing edge 132.

Exterior portions 154*e* of gage pad 150*e* as shown in FIG. 7D may be generally described as including curved segment 156*e* extending from trailing edge 132 toward leading edge 131. Exterior portion 154*e* of gage pad 150*e* may also be generally described as having noncurved, straight segment 158*e* extending from leading edge 131 toward trailing edge 132. Generally curved segment 156*e* may intersect with noncurved, straight segment 158*e* between respective leading edge 131 and trailing edge 132.

For embodiments such as shown in FIG. 7D, generally curved segment 156*e* may be disposed at a relatively uniform radius corresponding with radius 161 extending from associated bit rotational axis 104. For other applications (not expressly shown) curved segment 156*e* may include a negative radially tapered configuration similar to previously described radially tapered portion 156*d*.

Figure 8A:
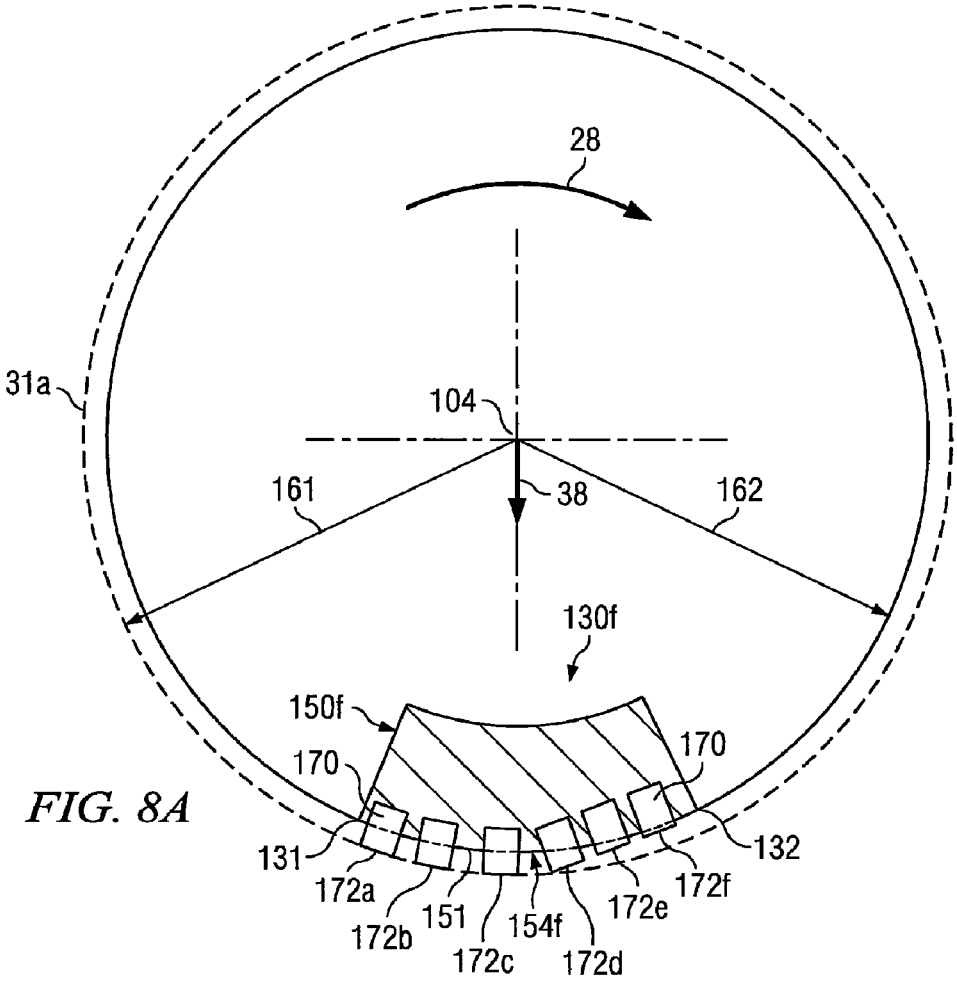
FIG. 8A is a schematic drawing in section with portions broken away showing one example of a blade and associated gage pad which may be disposed on a rotary drill bit in accordance with teachings of the present disclosure.
Figure 8B:
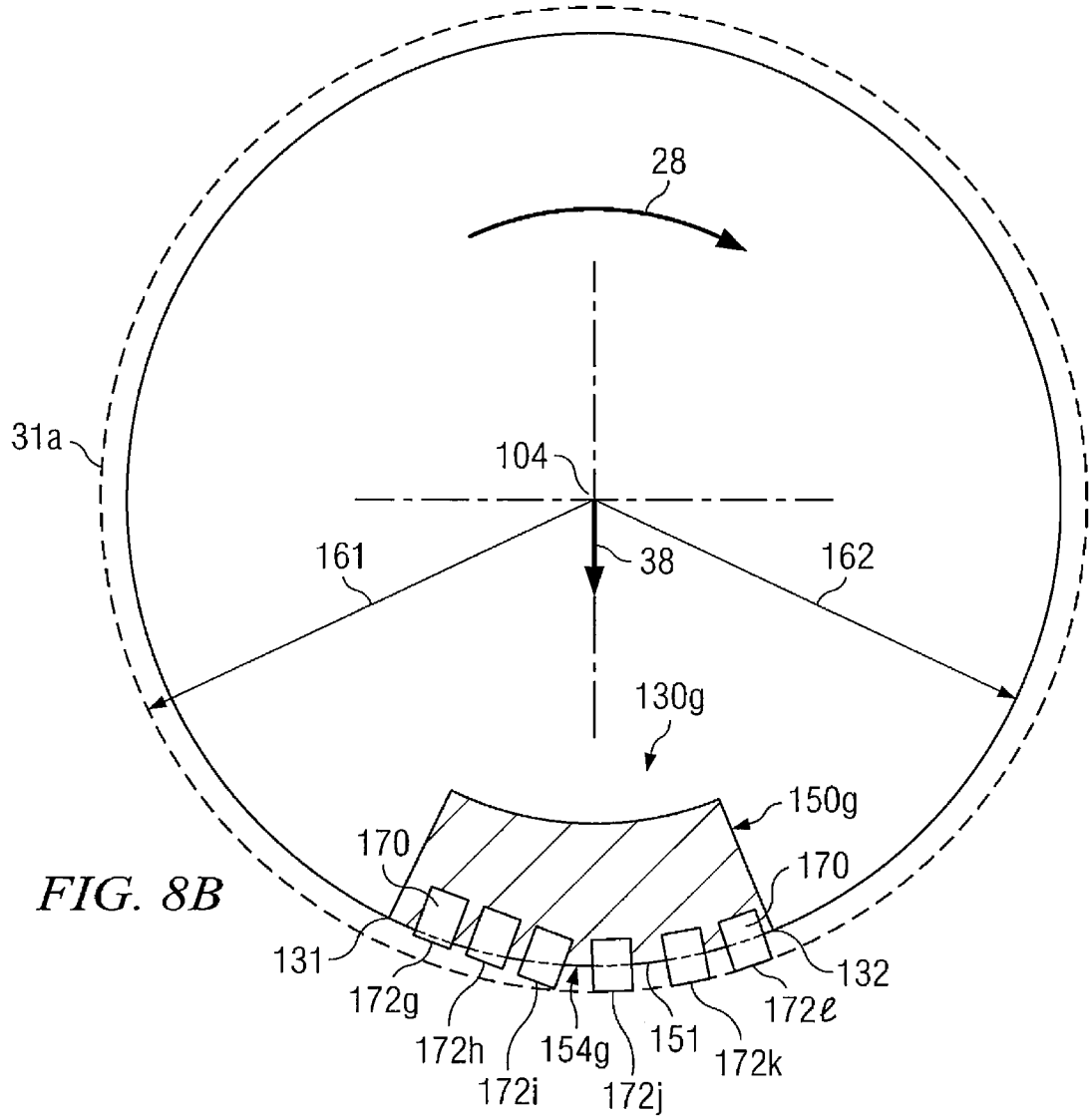
FIG. 8B is a schematic drawing in section with portions broken away showing another example of a blade and associated gage pad which may be disposed on a rotary drill bit in accordance with teachings of the present disclosure.

FIGS. 8A and 8B show respective examples of blades and associated gage pads incorporating teachings of the present disclosure. A single row of compacts or buttons are shown on exterior portions of the gage pads in FIGS. 8A and 8B. However, multiple rows or an array of compacts or buttons may be disposed on exterior portions of a gage pad incorporating teachings of the present disclosure.

Blades 130*f* and 130*g* may include respective gage pads 150*f* and 150*g* defined in part by respective leading edges 131 and trailing edges 132. Respective uphole and downhole edges associated with each gage pad 150*f* and 150*g* are not expressly shown. For embodiments represented by gage pads 150*f* and 150*g*, respective leading edges 131 and trailing edges 132 may be disposed at approximately the same radial distance (second radius 162) from associated bit rotational axis 104.

For purposes of describing various features of the present disclosure exterior surfaces 172 of compacts 170 in FIG. 8A have been designated as 172*a*-172*f* and exterior surfaces 172 of compacts 170 in FIG. 8B have been designated as 172*g*-172*l*. For some applications exterior surfaces 172*a*-172*f* and/or 172*g*-172*l* may have approximately the same overall configuration and dimensions. For other applications exterior surfaces 172*a*-172*f* and/or 172*g*-172*l* may be varied with respect to size, dimensions and/or configurations based at least in part on anticipate wear during formation of non-straight segments of a wellbore.

A plurality of compacts or buttons 170 may be disposed in exterior portion 154*f* of gage pad 150*f* as shown in FIG. 8A. Each compact 170 may include respective exterior surfaces 172*a*-172*f* extending from exterior portion 154*f* of gage pad 150*f*. For embodiments such as shown in FIG. 8A, exterior surface 172*a* may be disposed at the longest radial distance from associated bit rotational axis 104. For some drill bit designs first radius 161 may also correspond with approximately one half of the nominal bit diameter ($D_b$) of an associated rotary drill bit.

Exterior surface 172*f* may be disposed at the shortest radial distance from associated bit rotational axis 104. Exterior surface 172*f* may correspond approximately with second radius 162 or the radial distance from bit rotational axis 104 to exterior portion 154*f* proximate trailing edge 132 of gage pad 150*f*. For some applications, leading edge 131 and trailing edge 132 may both be disposed at approximately the same radial distance (second radius 162) from associated bit rotational axis 104.

Exterior surface 172*b* and 172*c* may be disposed at approximately the same radial distance as exterior surface 172*a* from associated bit rotational axis 104. Exterior surface 172*d* may be disposed at a reduced radius relative to associated bit rotational axis 104 as compared with exterior surfaces 172*a*, 172*b* and 172*c*. Exterior surface 172*e* may be disposed at a radius less than exterior surface 172*d* but greater than exterior surface 172*g*.

Exterior surfaces 172*a*, 172*b* and 172*c* may cooperate with each other to form a curved segment having a relatively uniform radius. Exterior surfaces 172*d*, 172*e* and 172*f* with respective decreasing radii relative to associated bit rotational axis 104 may form a positive radially tapered segment. As a result, exterior surfaces 172*a*-172*e* of compacts 170 disposed on gage pad 150*f* may be described as forming an exterior configuration similar to previously described exterior portion 154*b* of FIG. 7A. For other embodiments (not expressly shown), exterior surfaces 172*a*-172*e* may be disposed with respective radii forming a continuous positive tangent taper between leading edge 131 and trailing edge 132.

A plurality of compacts or buttons 170 may be disposed in exterior portion 154*g* of gage pad 150*g* as shown in FIG. 8B. Compacts 170 may include respective exterior surfaces 172*g*-172*l* extending from exterior portion 154*g* of gage pad 150*g*.

For embodiments such as shown in FIG. 8B exterior surface 172*g* may be disposed at the shortest radial distance from associated bit rotational axis 104. Exterior surface 172*g* may correspond approximately with second radius 162 or the radial distance from bit rotational axis 104 to exterior portion 154*g* approximate both leading edge 131 and trailing edge 132 of gage pad 150*g*. Exterior surface 172*l* may be disposed at the longest distance from associated bit rotational axis 104. Exterior surface 172*l* may correspond approximately with first radius 161. For some drill bit designs radius 161 may be approximately one half of the nominal bit diameter ($D_b$) of an associated rotary drill bit.

Exterior surface 172*h* may be disposed at a greater radial distance from associated bit rotational axis 104 as compared with exterior surface 172*g*. Exterior surface 172*i* may be disposed at a greater radial distance from associated bit rotational axis 104 as compared with exterior surface 172*h* but less than the radial distance of exterior surface 172*j*. Exterior surfaces 172*j* and 172*k* may be disposed at approximately the same radial distance from associated bit rotational axis 104 as exterior surface 172*l*.

Exterior surfaces 172*g*, 172*h* and 172*i* with increasing radii relative to associated bit rotational axis 104 may cooperate with each other to form a negative radially tapered segment. Exterior surfaces 172*j*, 172*k* and 172*l* may cooperate with each other to form a curved segment having a relatively uniform radius. As a result, exterior surfaces 172*j*-172*l* of compacts 170 disposed on gage pad 150*g* may be described as having a radially tapered exterior configuration similar to previously discussed radially tapered segment 156*d* in FIG. 7D. For other embodiments (not expressly shown) exterior surfaces 172*g*-172*l* may be disposed with respective radii forming a continuous negative radial tangent taper between leading edge 131 and trailing edge 132.

FIGS. 9A-9D show respective examples of gage pads incorporating teachings of the present disclosure. Gage pads 150*h* and 150*i* may be defined in part by respective leading edges 131, trailing edges 132, uphole edges 151 and downhole edges 152. For some applications exterior portions of gage pads 150*h* and 150*i* may have no axial taper and/or no radial taper. For other applications exterior portions of gage pad 150*h* and/or gage pad 150*i* may have respective axial tapers and/or radial tapers such as shown in FIGS. 5, 7A-7D, and 10A-10J.

Figure 9A:
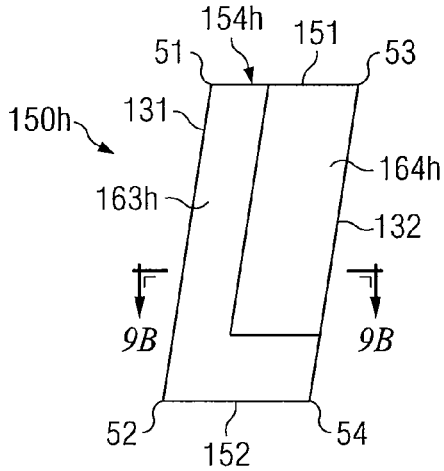
FIG. 9A is a schematic drawing showing a side view of one example of a gage pad incorporating teachings of the present disclosure.
Figure 9C:
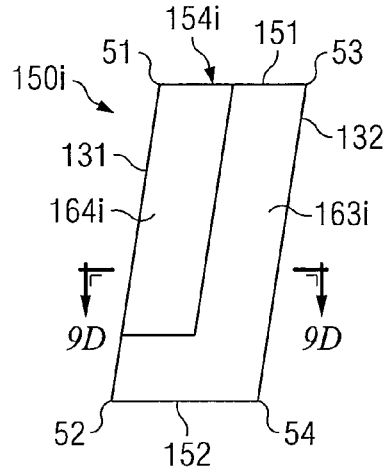
FIG. 9C is a schematic drawing showing a side view of another example of a gage pad incorporating teachings of the present disclosure.
Figure 9B:
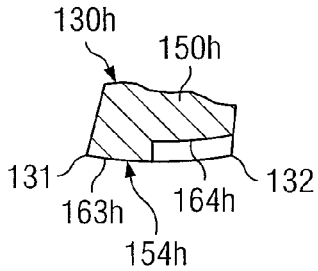
FIG. 9B is a schematic drawing in section taken along lines 9B-9B of FIG. 9A.

Exterior portion 154*h* of gage pad 150*h* as shown in FIGS. 9A and 9B may include first segment 163*h* and second segment or recessed portion 164*h*. Second segment 164*h* may be generally described as a recess or cut out formed in exterior portion 154*h* of gage pad 150*h*. Second segment 164*h* may be disposed at a reduced radius relative to an associated bit rotational axis as compared with first segment 163*h*. See FIG. 9B. Second segment 164*h* may also be described as having less exposure to adjacent portions of a wellbore formed by an associated rotary drill bit as compared to first segment 163*h*.

For embodiments such as shown in FIGS. 9A and 9B first segment 163*h* may have a generally "L shape" configuration extending from top edge 151 to downhole edge 152 adjacent to leading edge 131 and extending from leading edge 131 to trailing edge 132 adjacent downhole edge 152. Recessed portion 164*h* may have an overall configuration of a parallelogram similar to, but smaller than, the overall configuration of exterior portion 154*h* of gage pad 150*h*.

Recessed portion 164*h* may extend from point 53 towards leading edge 131 and downhole edge 152. The location and/or dimensions associated with recessed portion 164*h* may be selected to minimize wear on exterior portion 154*h* of gage pad 150*h*, particularly during the formation of a non-straight wellbore. For example, the dimensions and configuration of recessed portion 164*h* may be selected to accommodate the configuration and dimensions of wear zone 154*w* as shown in FIG. 6B.

Figure 9D:
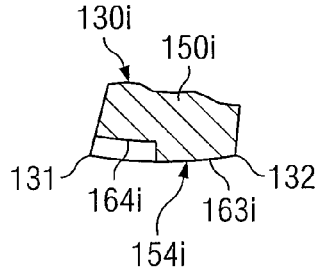
FIG. 9D is a schematic drawing in section taken along lines 9D-9D of FIG. 9C.

Exterior portion 154*i* of gage pad 150*i* as shown in FIGS. 9C and 9D may include leading edge 131 with one or more active components or cutting elements (not expressly shown). Exterior portion 154*i* may include first segment 163*i* and second segment or recessed portion 164*i*. Second segment 164*i* may be generally described as a recess or cutout formed in exterior portion 154*i* of gage pad 150*i*. Second segment 164*i* may be disposed at a reduced radius relative to an associated bit rotational axis as compared with first segment 163*i*. See FIG. 9D. Second segment 164*i* may also be described as having less exposure to adjacent portions of a wellbore formed by an associated rotary drill bit as compared with first segment 163*i*.

For embodiments such as shown in FIG. 9C first segment 163*i* may be described as having a generally inverted "L shape" configuration extending from leading edge 131 to trailing edge 132 adjacent to uphole edge 151 and extending from uphole edge 151 to downhole edge 152 adjacent to trailing edge 132. Recessed portion 164*i* may have an overall configuration of a parallelogram similar to, but smaller than, the overall configuration of exterior portion 154*i* of gage pad 150*i*.

Recessed portion 164*i* may extend from point 51 toward trailing edge 132 and down edge 152. The location and/or dimensions associated with recessed portion 164*i* may be selected to minimize wear on exterior portions 154*i* of gage pad 151 adjacent to leading edge 131, particularly during the formation of a non-straight wellbore. For example, the dimensions and configuration of recessed portion 164*i* may be selected to accommodate a simulate wear zone extending from point 52 if gage pad 150*i* had a more uniform exterior portion adjacent to leading edge 131 similar to first segment 163*i*.

FIGS. 10A-10J show respective examples of blades and associated gage pads incorporating teachings of the present disclosure. Gage pads 150*j* and 150*k* may be defined in part by respective leading edges 131, trailing edges 132, uphole edges 151 and downhole edges 152. Gage pad 150*j* and 150*k* may have respective exterior portions 154*j* and 154*k* which may be both radially tapered and axially tapered in accordance with teachings of the present disclosure.

Exterior portion 154*j* of gage pad 150*j* may have varying positive radial taper angles (See FIGS. 10B and 10C) and varying positive axial taper angles (See FIGS. 10D and 10E). Exterior portion 154*k* of gage pad 150*k* may have varying negative radial taper angles (See FIGS. 10G and 10H) and varying negative axial taper angles (See FIGS. 10I AND 10J).

Exterior portion 154 of gage pad 150 may also have varying positive radial taper angles together with varying negative axial taper angles or varying negative radial taper angles together with varying positive axial taper angles (not shown).

For embodiments such as shown in FIGS. 10A-10E exterior portion 154*j* of gage pad 150*j* may be generally described as a complex surface defined in part by varying radii extending from an associated bit rotational axis. For some designs incorporating teachings of the present disclosure, downhole edge 152 of gage pad 150*j* may have a relatively uniform radius extending from an associated bit rotational axis and may correspond approximately with one half of the nominal bit diameter ($D_b$) of an associated rotary drill bit. See FIGS. 10C and 10D. As a result, downhole edge 152 at leading edge 131 of gage pad 150*j* may generally be disposed proximate the nominal diameter of an associated drill bit or corresponding diameter for other downhole tools having gage pad 150.

The radial distance from the associated bit rotational axis to leading edge 131 of gage pad 150*j* may generally decrease from downhole edge 152 to uphole edge 151. See FIGS. 10B, 10D and 10E. As a result trailing edge 132 will generally be spaced a greater distance from nominal diameter of the associated drill bit as compared to leading edge 131 or corresponding diameter for other downhole tools having gage pad 150;

Uphole edge 151 may generally have a decreasing radius between leading edge 131 and trailing edge 132 as measured from the associated bit rotational axis. As a result, leading edge 131 adjacent to uphole edge 151 may be spaced approximately first distance 91 from nominal diameter of the associated drill bit or corresponding diameter for other downhole tools having gage pad 150; see FIG. 10B. Trailing edge 132 may be spaced second distance 92 from nominal diameter of the associated drill bit or corresponding diameter for other downhole tools having gage pad 150. Trailing edge 132 adjacent to downhole edge 152 may be approximately spaced approximately third distance 93 from nominal diameter of the associated drill bit or corresponding diameter for other downhole tools. Second distance 92 may be greater than third distance 93.

As a result, exterior portion 154*j* may have varying negative axial taper angles between leading edge 131 and trailing edge 132. First axial taper angle 81*j* proximate leading edge 131 may be smaller than second axial taper angle 82*j* proximate trailing edge 132. See FIGS. 10D and 10E. Positive radial taper angles on exterior portion 154*j* may remain relatively uniform between leading edge 131 and trailing edge 132 or may increase in value adjacent to trailing edge 132 as compared with radial tangent taper angles adjacent to leading edge 131.

For embodiments such as shown in FIGS. 10E-10J exterior portion 154*k* of gage pad 150*k* may be generally described as a complex surface defined in part by varying radii extending from an associated bit rotational axis. Leading edge 131 of gage pad 150*k* may have one or more active components or cutting elements (not expressly shown). Uphole edge 151 of gage pad 150*k* may be disposed along relatively uniform radius 161 extending from the associated bit rotational axis which may also correspond with approximately with one half of the nominal diameter ($D_b$) of an associated rotary drill bit. As a result, uphole edge 151 of gage pad 150*k* may generally be disposed proximate the nominal diameter of the associated drill bit. See FIGS. 10I and 10J.

The radial distance to leading edge 131 of gage pad 150*k* from the associated bit rotational axis may generally decrease from uphole edge 151 to downhole edge 152. See FIGS. 10G, 10H and 10I. As a result, leading edge 131 will generally be spaced at a greater distance from adjacent portions of the associated wellbore as compared with trailing edge 132.

Downhole edge 152 may generally have a decreasing radius starting from trailing edge 132 and moving toward leading edge 131 as measured from the associated bit rotational axis. As a result, trailing edge 131 adjacent to uphole edge 151 at point 53 may be disposed adjacent to the nominal diameter of the associated drill bit or corresponding diameter of another downhole tool having gage pad 150*k* disposed thereon. See FIGS. 10G and 10J.

Trailing edge 132 adjacent to downhole edge 152 may be spaced first distance 91 from radius 161 at uphole edge 151. See FIG. 10H. Leading edge 131 proximate downhole edge 152 may be spaced approximately second distance 92 from radius 161 at uphole edge 151. See FIG. 10H. Leading edge 131 may be spaced approximately third distance 93 relative to radius 161 along uphole edge 151. See FIG. 10G.

As a result, exterior portion 154*k* may have varying negative axial taper angles between leading edge 131 and trailing edge 132. First negative axial taper angle 81*k* proximate trailing edge 132 may be smaller than second negative axial taper angle 82*k* adjacent to leading edge 131. See FIGS. 10I and 10J. Negative radial taper angles may remain relatively uniform between leading edge 131 and trailing edge 132 or may increase in value adjacent to leading 131 as compared with radial taper angles adjacent to trailing edge 132.

FIGS. 11A-11F show respective examples of gage pads incorporating teachings of the present disclosure. Gage pads 150*l* and 150*m* may be generally described as having exterior portions formed with at least a first segment and a second segment in accordance with teachings of the present disclosure. For some applications the first segment and the second segment may have approximately the same overall configuration and dimensions other than respective taper angles. For other applications (not expressly shown) the first segment may be larger than or may be smaller than the associated second segment. Gage pads 150*l* and 150*m* may have exterior portions formed with approximately zero (0) radial taper.

Figure 11A:
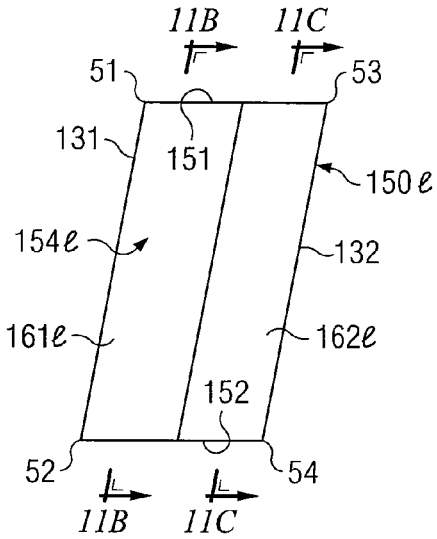
FIG. 11A is a schematic drawing showing a side view of one example of a gage pad incorporating teachings of the present disclosure.
Figure 11B:
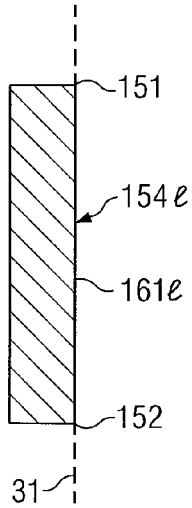
FIG. 11B is a schematic drawing in section taken along lines 11B-11B of FIG. 11A.
Figure 11C:
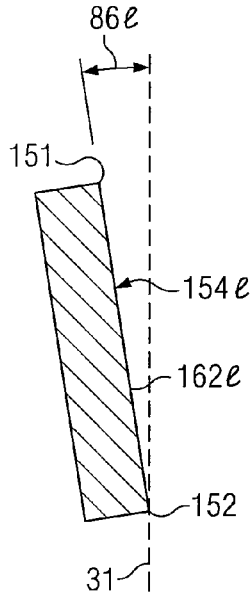
FIG. 11C is a schematic drawing in section taken along lines 11C-11C of FIG. 11A.

Gage pad 150*l* as shown in FIG. 11A may include exterior portion 154*l* defined in part by first segment 161*l* aligned approximately parallel with an associated bit rotational axis and adjacent portions of a straight wellbore formed by an associated rotary drill bit. See FIG. 11B. First segment 161*l* may have approximately no axial taper and no radial taper. Second segment 162*l* of exterior portion 154*l* may be disposed at positive axial taper 86*l* relative to a rotational axis of the associated drill bit. See FIG. 11C.

Figure 11D:
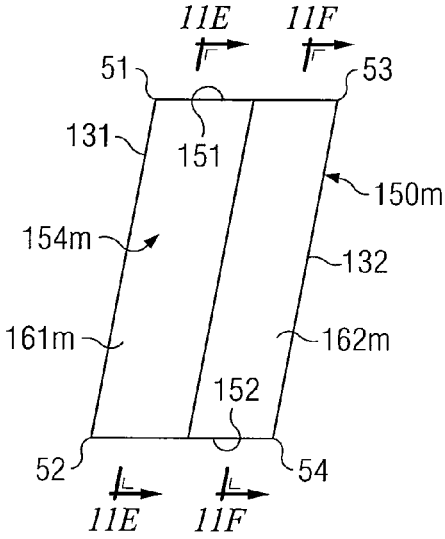
FIG. 11D is a schematic drawing showing a side view of another example of a gage pad incorporating teachings of the present disclosure.
Figure 11E:
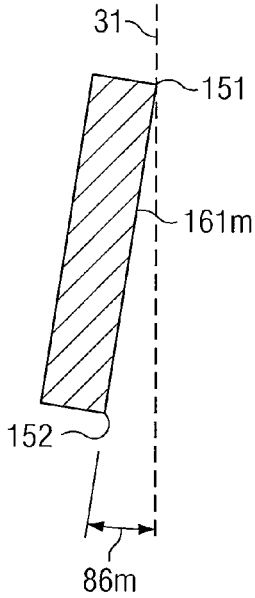
FIG. 11E is a schematic drawing in section taken along lines 11E-11E of FIG. 11D.
Figure 11F:
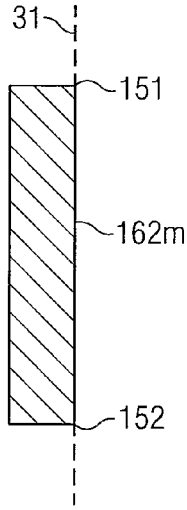
FIG. 11F is a schematic drawing in section taken along lines 11F-11F of FIG. 11D.

Gage pad 150*m* as shown in FIG. 11D may include exterior portion 154*m* having first segment 161*m* and second segment 162*m*. First segment 161*m* may be disposed at negative axial taper 86*m* relative to a rotational axis of the associated drill bit. See FIG. 11E. Angle 86*m* may be varied to optimize performance of an associated rotary drill bit having active components or cutting elements (not expressly shown) disposed adjacent to leading edge 131 of each gage pad 150*m*. Second segment 162*m* may be aligned approximately parallel with an associated bit rotational axis and adjacent portions of a straight wellbore formed by the associated rotary drill bit. See FIG. 11F. Second segment 162*n* may have approximately no axial taper and no radial taper.

FIGS. 12A-12F show respective examples of gage pads incorporating teachings of the present disclosure. Gage pads 150*n* and 150*o* may be generally described as having respective exterior portions formed with at least a first axially tapered segment and a second axially tapered segment in accordance with teachings of the present disclosure. For some applications, the first axially tapered segment and the second axially tapered segment may have approximately the same overall configuration and dimensions except for associated taper angles. For other applications (not expressly shown), the first axially tapered segment may be larger than or may be smaller than the associated second axially tapered segment.

Figure 12A:
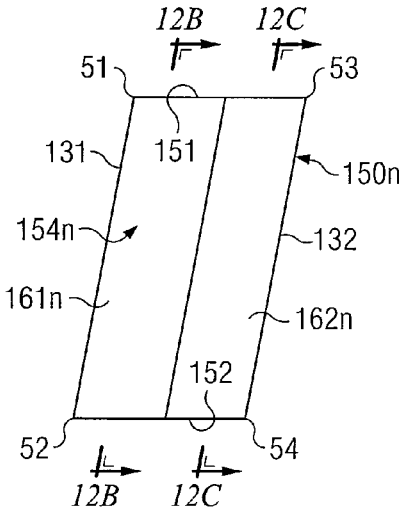
FIG. 12A is a schematic drawing showing a side view of still another example of a gage pad incorporating teachings of the present disclosure.
Figure 12B:
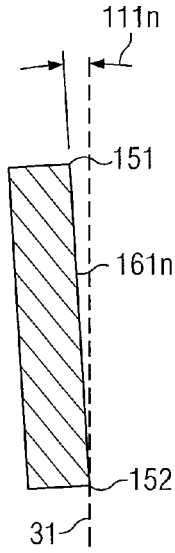
FIG. 12B is a schematic drawing in section taken along lines 12B-12B of FIG. 12A.
Figure 12C:
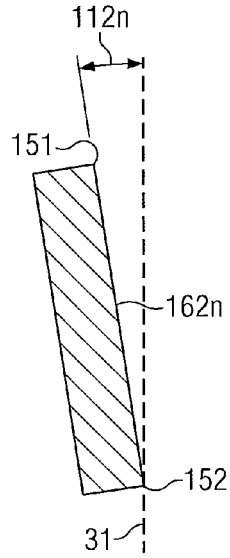
FIG. 12C is a schematic drawing in section taken along lines 12C-12C of FIG. 12A.

Gage pad 150*n* as shown in FIGS. 12A, 12B and 12C may include exterior portion 154*n* defined in part by first segment 161*n* and second segment 162*n*. First segment 161*n* may be disposed relative to a rotational axis of the associated drill bit forming first positive axial taper angle 111*n*. Second segment 162*n* may be disposed relative to the associated bit rotational axis forming second positive axial taper angle 112*n*. For embodiments such as shown in FIGS. 12A-12C first positive axial taper angle 111*n* may be smaller than second positive taper angle 112*n*. See FIGS. 12B and 12C.

Figure 12D:
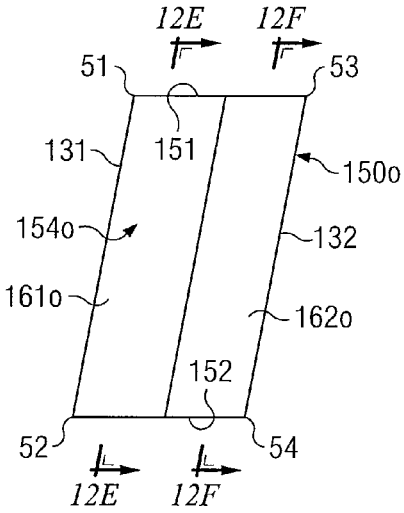
FIG. 12D is a schematic drawing showing a side view of a further example of a gage pad incorporating teachings of the present disclosure.
Figure 12E:
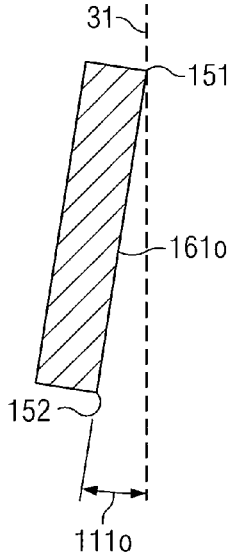
FIG. 12E is a schematic drawing in section taken along lines 12E-12E of FIG. 12D.
Figure 12F:
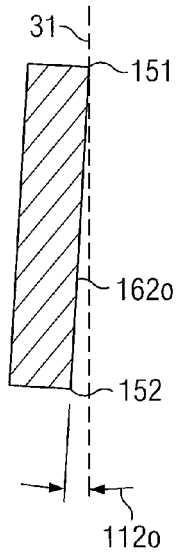
FIG. 12F is a schematic drawing in section taken along lines 12F-12F of FIG. 12D.

Gage pad 150*o* as shown in FIGS. 12D, 12E and 12F may include exterior portion 154*o* defined in part by first segment 161*o* and second segment 162*o*. First segment 161*o* may be disposed relative to a rotational axis of the associated drill bit forming first negative axial taper angle 111*o*. Second segment 162*o* may disposed relative to the associated bit rotational axis forming second negative axial taper angle 112*o*. For embodiments such as shown in FIGS. 12D-12F first negative axial taper angle 111*o* may be larger than second negative taper angle 112*o*. See FIGS. 12E and 12D.

Although the present disclosure and its advantages have been described in detail, it should be understood that various changes, substitutions and alternations can be made herein without departing from the spirit and scope of the disclosure as defined by the following claims.

What is claimed is:

1. A rotary drill bit operable to form a wellbore comprising:
- a bit body having one end operable for attachment to a drill string;
- a bit rotational axis extending through the bit body;
- a plurality of blades disposed on exterior portions of the bit body;
- at least one of the blades having a gage pad with an exterior surface operable to contact adjacent portions of a wellbore formed by the rotary drill bit;
- the exterior surface of the gage pad including:
  - an uphole edge with a leading edge defined in part by a first radius extending from the bit rotational axis to the uphole edge and a trailing edge defined in part by a second radius extending from the bit rotational axis to the uphole edge, the first radius larger than the second radius as measured in a plane extending generally perpendicular to the bit rotational axis, the leading edge and the trailing edge extending downhole from the uphole edge;
  - a generally curved surface extending from the leading edge toward the trailing edge of the gage pad; and
  - a generally flat, noncurved surface extending from the trailing edge toward the leading edge of the gage pad, the generally flat, noncurved surface intersecting with the generally curved surface.

2. The rotary drill bit of claim 1 further comprising the generally curved surface having a radius approximately equal to the first radius extending between the bit rotational axis and the leading edge of the gage pad.

3. A rotary drill bit operable to form a wellbore comprising:
- a bit body having one end operable for attachment to a drill string;
- a bit rotational axis extending through the bit body;
- a plurality of blades disposed on exterior portions of the bit body;
- at least one of the blades having a gage pad with an exterior surface operable to contact adjacent portions of a wellbore formed by the rotary drill bit;
- the exterior surface of the gage pad including:
  - an uphole edge with a leading edge defined in part by a first radius extending from the bit rotational axis to the uphole edge and a trailing edge defined in part by a second radius extending from the bit rotational axis to the uphole edge, the second radius larger than the first radius as measured in a plane extending generally perpendicular to the bit rotational axis, the leading edge and the trailing edge extending downhole from the uphole edge;
  - a generally curved surface extending from the trailing edge toward the leading edge of the gage pad; and
  - a generally flat, noncurved surface extending from the leading edge toward the trailing edge of the gage pad, the generally flat, noncurved surface intersecting with the generally curved surface.

4. The rotary drill bit of claim 3 further comprising the generally curved surface having a radius approximately equal to the second radius extending between the bit rotational axis and the trailing edge of the gage pad.

5. A rotary drill bit operable to form wellbore comprising:
- a bit body having a bit rotational axis extending through the bit body;
- a plurality of cutting elements extending from the bit body;
- at least one gage segment defined in part by an exterior surface;
- the at least one gage segment having a respective leading edge and a respective trailing edge;
- a recessed portion formed in the exterior surface of the at least one gage segment;
- the recessed portion having a reduced radius relative to the bit rotational axis; and
- the recessed portion having an overall configuration of a parallelogram.

6. The rotary drill bit of claim 5 further comprising:
- the recessed portion disposed adjacent to the respective trailing edge; and
- the recessed portion extending from a respective uphole edge of at least one gage segment toward a respective downhole edge of at least one gage segment.

7. The rotary drill bit of claim 5 further comprising:
- the recessed portion disposed adjacent to the respective trailing edge; and
- the recessed portion extending from a respective uphole edge of at least one gage segment toward a respective downhole edge of at least one gage segment.

8. The rotary drill bit of claim 5 further comprising:

the exterior surface of the at least one gage pad disposed adjacent to the respective leading edge having a generally uniform radius corresponding approximately with a generally uniform radius extending between the bit rotational axis and the leading edge of at least one gage pad; and the recessed portion defined in part by the radius extending from the bit rotation axis to the recessed portion less than the generally uniform radius at the leading edge of at least one gage pad.

9. The rotary drill bit of claim 5 further comprising a fixed cutter drill bit.

10. The rotary drill bit of claim 5 further comprising a roller cone drill bit.

11. A fixed cutter rotary drill bit operable to form wellbore comprising:

a bit body having one end operable for attachment to a drill string;

a bit rotational axis extending through the bit body;

a plurality of blades disposed on exterior portions of the bit body;

each of the blades having a respective gage portion operable to contact adjacent portions of a wellbore formed by the rotary drill bit;

the gage portion of each blade having a respective leading edge and a respective trailing edge;

a respective cut out formed in each gage portion adjacent to the respective trailing edge;

the cut out having a reduced radius relative to the bit rotational axis; and the cut out having an overall configuration of a parallelogram.

12. The rotary drill bit of claim 11 further comprising each cutout extending from a respective uphole edge of each gage portion toward a respective downhole edge of each gage portion.

13. The rotary drill bit of claim 11 further comprising:

an exterior surface of each gage portion adjacent to the respective leading edge having a generally uniform radius extending from the bit rotational axis; and the respective cut out disposed in each gage portion proximate the respective trailing edge.

14. A rotary drill bit operable to form a wellbore comprising:

a bit body having a bit rotational axis extending from the bit body;

a plurality of blades disposed on and extending from the bit body;

at least one of the blades having a gage pad defined in part by an uphole edge with a leading edge and a trailing edge extending downhole therefrom;

the leading edge of the gage pad disposed at a first, generally uniform radial distance extending from the bit rotational axis;

the trailing edge of the gage pad disposed at varying radial distances from the bit rotational axis;

the radial distance from the bit rotational axis to a downhole edge of the gage pad proximate the leading edge generally equal to the radial distance from the bit rotational axis to the downhole edge of the gage pad proximate the trailing edge; and the radial distance between the bit rotational axis and the uphole edge of the gage pad decreasing between the leading edge and the trailing edge as measured in a plane extending generally perpendicular to the bit rotational axis; and a cut out formed in the gage pad proximate the trailing edge.

15. A rotary drill bit operable to form a wellbore comprising:

a bit body having a bit rotational axis extending from the bit body;

a plurality of blades disposed on and extending from the bit body;

at least one of the blades having a gage pad defined in part by an uphole edge with a leading edge and a trailing edge extending downhole therefrom;

the leading edge of the gage pad disposed at a first, generally uniform radial distance extending from the bit rotational axis;

the trailing edge of the gage pad disposed at varying radial distances from the bit rotational axis;

the radial distance from the bit rotational axis to a downhole edge of the gage pad proximate the leading edge generally equal to the radial distance from the bit rotational axis to the downhole edge of the gage pad proximate the trailing edge; and the radial distance between the bit rotational axis and the uphole edge of the gage pad decreasing between the leading edge and the trailing edge as measured in a plane extending generally perpendicular to the bit rotational axis;

a tapered exterior surface disposed adjacent to the trailing edge of the gage pad;

the tapered surface extending from the uphole edge to the downhole edge of the gage pad; and the gage pad having a generally uniform surface without any taper disposed adjacent to the leading edge.

16. The rotary drill bit of claim 15 further comprising:

the gage pad having a perimeter corresponding generally with a first parallelogram;

the tapered surface having a respective perimeter corresponding with approximately one half of the first parallelogram; and the generally uniform surface having a perimeter corresponding with approximately one-half of the first parallelogram.

17. A rotary drill bit operable to form a wellbore comprising:

a bit body having a bit rotational axis extending from the bit body;

a plurality of blades disposed on and extending from the bit body;

at least one of the blades having a gage pad defined in part by an uphole edge with a leading edge and a trailing edge extending downhole therefrom;

the leading edge of the gage pad disposed at a first, generally uniform radial distance extending from the bit rotational axis;

the trailing edge of the gage pad disposed at varying radial distances from the bit rotational axis;

the radial distance from the bit rotational axis to a downhole edge of the gage pad proximate the leading edge generally equal to the radial distance from the bit rotational axis to the downhole edge of the gage pad proximate the trailing edge; and the radial distance between the bit rotational axis and the uphole edge of the gage pad decreasing between the leading edge and the trailing edge as measured in a plane extending generally perpendicular to the bit rotational axis;

a generally nontapered surface extending from the leading edge toward the trailing edge of the at least one gage pad;

a generally tapered surface extending from the trailing edge of the at least one gage pad; and the generally tapered surface intersecting with the nontapered surface extending from the leading edge of the at least one gage pad.

18. A fixed cutter drill bit operable to form a wellbore in a downhole formation comprising:

a bit body having one end operable to releasably engage the drill bit with a drill string;

a bit rotational axis extending through the bit body;

a bit face profile defined in part by a plurality of blades disposed on exterior portions of the bit body;

each blade having a gage pad;

each blade and respective gage pad having a leading edge and a trailing edge;

at least one of the gage pads having an exterior portion defined in part by a first tapered surface and a second tapered surface;

the first tapered surface disposed adjacent to a leading edge of the at least one gage pad;

the second tapered surface disposed adjacent to a trailing edge of the at least one gage pad;

the first tapered surface having a respective axial taper and the second tapered surface having a respective axial taper; and the respective axial taper of the first axially tapered surface not equal to the respective axial taper of the second axially tapered surface.

19. The drill bit of claim 18 further comprising a cutout portion formed in the second tapered surface adjacent to the trailing edge of the at least one gage pad.

20. The drill bit of claim 18 further comprising the cutout portion extending from an uphole edge of the gage pad toward a downhole edge of the at least one gage pad.

21. A method of forming at least one gage pad on at least one component of a rotary drill string used to form a wellbore comprising:

forming the at least one gage pad with an exterior portion having an uphole edge with a leading edge and a trailing edge extending downhole therefrom;

placing a plurality of compacts on the exterior portions of the at least one gage pad with each compact having a respective exterior surface disposed at a respective radial distance from an associated rotational axis;

placing at least one of the respective compacts proximate the leading edge of the gage pad;

placing at least one of the respective compacts proximate the trailing edge of the at least one gage pad; and arranging respective exterior surfaces of the compacts in a generally radially tapered configuration extending from proximate the leading edge of the gage pad to proximate the trailing edge of the gage pad as measured in a plane extending generally perpendicular to the bit rotational axis; and forming the at least one gage pad on exterior portions of a support arm associated with a roller cone drill bit.

22. A method of forming at least one gage pad on at least one component of a rotary drill string used to form a wellbore comprising:

forming the at least one gage pad with an exterior surface operable to contact adjacent portions of the wellbore;

forming the exterior surface of the at least one gage pad with an uphole edge having a leading edge and a trailing edge extending downhole therefrom;

forming the leading edge with a first radius extending from an associated rotational axis to the uphole edge;

forming the trailing edge with a second radius extending from an associated rotational axis to the uphole edge; and forming the first radius and the second radius with respective values which are not equal as measured in a plane extending generally perpendicular to the bit rotational axis.

23. The method of claim 22 further comprising forming a generally continuous radially tapered surface on the at least one gage pad extending from proximate the leading edge to proximate the trailing edge of the gage pad.

24. The method of claim 22 further comprising forming a generally curved surface extending from the trailing edge toward the leading edge of the at least one gage pad;

forming a generally flat, non-curved surface extending from the leading edge toward the trailing edge of the at least one gage pad; and forming an intersection between the generally flat non-curved surface and the generally curved surface intermediate the leading edge and the trailing edge of the at least one gage pad.

* * * * *